US010974884B2

(12) United States Patent
Van Der Molen

(10) Patent No.: US 10,974,884 B2
(45) Date of Patent: Apr. 13, 2021

(54) CLOSURE ASSEMBLY AND CONTAINER PROVIDED WITH SAID CLOSURE ASSEMBLY

(71) Applicant: Scholle IPN IP B.V., SX Tilburg (NL)

(72) Inventor: Peter Jan Van Der Molen, The Hague (NL)

(73) Assignee: Scholle IPN IP BV, Tilburg (NL)

( * ) Notice: Subject to any disclaimer, the term of this patent is extended or adjusted under 35 U.S.C. 154(b) by 134 days.

(21) Appl. No.: 16/074,875

(22) PCT Filed: Feb. 3, 2017

(86) PCT No.: PCT/NL2017/050072

§ 371 (c)(1),
(2) Date: Aug. 2, 2018

(87) PCT Pub. No.: WO2017/135824

PCT Pub. Date: Aug. 10, 2017

(65) Prior Publication Data

US 2019/0144189 A1 May 16, 2019

(30) Foreign Application Priority Data

Feb. 3, 2016 (NL) ..... 2016212

(51) Int. Cl.
*B65D 75/58* (2006.01)
*B65D 41/34* (2006.01)

(52) U.S. Cl.
CPC ..... *B65D 75/5883* (2013.01); *B65D 41/3428* (2013.01); *B65D 2251/023* (2013.01); *B65D 2251/065* (2013.01); *B65D 2401/15* (2020.05); *B65D 2401/20* (2020.05); *B65D 2401/25* (2020.05); *B65D 2401/45* (2020.05); *B65D 2401/50* (2020.05); *B65D 2401/55* (2020.05)

(58) Field of Classification Search
CPC ..... B65D 41/32; B65D 41/46–48; B65D 41/3442; B65D 41/3447; B65D 75/5872;
(Continued)

(56) References Cited

U.S. PATENT DOCUMENTS 4,572,387 A * 2/1986 Luker ..... B65D 41/3452 215/252
4,613,052 A * 9/1986 Gregory ..... B65D 41/3433 215/252

(Continued)

FOREIGN PATENT DOCUMENTS

CN 101316769 A 12/2008
CN 102725203 A 10/2012

(Continued)

*Primary Examiner* — Jes F Pascua
*Assistant Examiner* — Nina K Attel
(74) *Attorney, Agent, or Firm* — The Watson IP Group, PLC; Jovan N. Jovanovic

(57) ABSTRACT

Closure assembly comprising a spout (1) and a cap (2) including a tamper-evident ring (3). The spout (1) has a neck (14) around a product passage (15) and a wall (10). The wall is spaced from the neck (14) to form an inner space (11) which is open from above to receive the tamper-evident ring (3). The tamper-evident ring (3) is integrally moulded via breakable bridges (34) to the cap and comprises a base portion (32) with at least one snap portion (33) at abase portion outer face (32*a*). The wall (10) of the spout (1) comprises at least one window (16), wherein the at least one snap portion (33) fits inside the window (16) to snap the tamper-evident ring (3) to the spout (1) when the tamper-evident ring (3) is inserted in the inner space (11).

20 Claims, 10 Drawing Sheets

(58) Field of Classification Search
CPC ..... B65D 75/5883; B65D 47/127; B65D 47/128; B65D 55/02; B65D 55/024; B65D 55/026; B65D 2101/0023; B65D 2101/0069; B65D 2101/0076; B65D 2101/003; B65D 2101/0038; B65D 43/0235; B65D 43/0237; B65D 43/0239; B65D 41/3428; B65D 2401/15; B65D 2401/25; B65D 2401/45
USPC ..... 383/80
See application file for complete search history.

(56) References Cited

U.S. PATENT DOCUMENTS

| | | | | |
|---|---|---|---|---|
| 8,231,025 | B2 * | 7/2012 | Johnson | B65D 41/0471 215/214 |
| 9,475,618 | B2 * | 10/2016 | Wohlgenannt | B65D 1/0246 |
| 2015/0129533 | A1 * | 5/2015 | Taber | B65D 75/5883 215/252 |
| 2017/0043921 | A1 * | 2/2017 | Elliott | B65D 39/08 |

FOREIGN PATENT DOCUMENTS

| | | | |
|---|---|---|---|
| CN | 103228548 | A | 7/2013 |
| EP | 2380820 | A1 | 10/2011 |
| GR | 2492586 | A | 9/2013 |
| WO | 2005070771 | A1 | 8/2005 |
| WO | 2007045894 | A1 | 4/2007 |
| WO | 2012044166 | A1 | 4/2012 |
| WO | 2014007612 | A1 | 1/2014 |
| WO | 2014196859 | A1 | 12/2014 |
| WO | 2017135824 | A1 | 8/2017 |

* cited by examiner

CLOSURE ASSEMBLY AND CONTAINER PROVIDED WITH SAID CLOSURE ASSEMBLY

The present invention relates to a closure assembly and a method for manufacturing a container provided with the closure assembly.

Closure assemblies are known with a plastic screw cap that can be removed by a rotational movement from a neck, e.g. of a plastic container with integrally molded neck or of a spout that has been fitted on a collapsible pouch container. In manufacturing such a closure assembly, a tamper-evident structure is often integrally molded as a part of the plastic screw cap. Examples of such closure assemblies are for example disclosed in WO2014/007612, WO2012/044166, and EP2380820. A further prior art closure assembly is for example known from GB 2492586.

The present invention aims to provide an improved closure assembly, or at least aims to provide an alternative for known closure assemblies.

According to a first aspect thereof the present invention achieves one or more of the above-mentioned objects by providing a closure assembly according to claim 1.

The closure assembly according to the first or any other aspect of the invention may provide one or more advantages.

Advantageously, the presence of the circumferential wall provides a shield that shields the tamper-evident ring that has been introduced in the inner space of the article. The tamper-evident ring is shielded by the wall which reduces a risk of an undesired release of the tamper-evident ring once the cap has been removed. The wall around the tamper-evident ring may make it more difficult to loosen the tamper-evident ring by an act from the outside, like for example releasing the ring by nibbling on the neck of an opened closure.

In an embodiment the annular base portion of the tamper-evident ring extends partially above the circumferential wall in an initial position thereof, when the cap has not been removed yet by a user, and is moved by said removal of the cap deeper into the inner space, into a lower position of the base portion, such that the base portion is fully received in the inner space, preferably the top of the annular base portion lying lower than the top of the circumferential wall. The difference between the initial position wherein the annular base portion sticks out above the circumferential wall and the lower position wherein the annular base portion no longer sticks out is well visible for the user.

In an embodiment the article on the one hand and the cap with tamper-evident ring on the other hand have different colours, which enhances the visual effect of the tamper-evident functionality, e.g. when the tamper-evident ring moves between higher and lower positions relative to the circumferential wall upon first time opening of the closure.

The presence of the at least one window in the circumferential wall may further provide one or more advantages.

An advantage of the at least one window may be that it provides an opportunity for a user to see that the closure assembly has been tampered with, e.g. one may see the position of the base portion and/or of the snap portion relative to the window, e.g. the difference between the initial position thereof and a lowered position thereof when applicable. The window acts as a viewing window which allows a user to see the snap portion of the tamper-evident ring from the outside. Preferably, the window has a height of at least 3 millimeters, e.g. between 3 and 7 millimeters.

A further advantage of the at least one window in the wall of the article is that a reduction of a volume of plastic material which is necessary to manufacture the article by e.g. injection moulding may be obtained. The closure assembly according to the invention is an item to be manufactured in a mass production. A small reduction of a volume of plastic material for each closure assembly results in a large reduction of plastic material and corresponding savings when producing millions of such closure assemblies.

In an embodiment the at least one snap portion is adapted to block or limit a rotational movement of the base portion of the tamper-evident ring within the inner space as the user removes the cap, e.g. as the user rotates the cap for opening. For example the at least one snap portion has a side stopper face which abuts against a face of the perimeter of the corresponding window in the wall, e.g. allowing for some rotation prior to said abutment. A retention of the base portion of the tamper-evident ring against such user induced rotation may also be achieved in other manners, e.g. the annular base portion having one or more other formations, e.g. on the outer face thereof, that mate with one or more complementary formations on the article, e.g. on the inner face of the circumferential wall, to block or limit such rotational motion. For example the base portion has one or more ribs or protrusions on its outer face that mate with one or more grooves, e.g. vertical grooves, on the inner face of the circumferential wall. In another embodiment the circumferential wall and the base portion of the tamper-evident ring have a non-circular contour, e.g. oval, square, rectangular, e.g. square or rectangular with rounded corners, or the like, so as to cause a blocking of the base portion of the tamper-evident ring against such rotation. In yet another embodiment the inner face of the tamper-evident ring is provided with one or more ribs or protrusions that mate with one or more grooves, e.g. vertical grooves, on the lower region of the neck to prevent or limit rotation of the ring relative to the neck. Or the inner face of the ring is provided with one or more grooves and one or more ribs or protrusions are present on the lower region of the neck.

Possibly one or more of these grooves are embodied in bayonet shape with a first vertical portion and a second adjoining portion that extends horizontally or at an incline. The latter may be used to act as a ramp for a protrusion received in the groove, thereby pulling the tamper-evident ring into the space between the neck and the circumferential wall upon first time opening of the cap by user induced rotation. In an embodiment the bayonet groove is formed on the lower region of the neck, wherein the second portion of the groove is preferably formed in the neck opposite a window in the circumferential wall, allowing a movable core member forming said window to also form at least said second portion of the groove.

In addition to the blockage of an axial movement of the tamper-evident ring, the blockage or limitation of the rotational movement further increases the reliability of retention of the tamper-evident ring when opening the closure assembly for the first time. The rotational retention in addition to the axial retention contributes to a reliable breakage of the bridges in between the skirt and the base portion of the tamper-evident ring. Also the additional rotational retention further contributes to a prevention of a release of the tamper-evident ring from the article.

In an embodiment the tamper-evident ring and circumferential wall form one, e.g. primary, cooperating snap connection, and the tamper-evident ring and the neck form another, e.g. secondary, cooperating snap connection, e.g. the latter only in a lowered position of the tamper-evident ring to retain said ring in said lowered position.

In practical embodiments a width of the snap portion and of a corresponding window are in a range of at least 4 till at most 15 millimetres, e.g. the window having a width somewhat greater than the snap portion.

Above mentioned advantages may be cumulatively obtained which means that both a shielded, reliable retention of the tamper-evident ring, an enhanced visual evidence of tempering, and a considerable saving in plastic material may be enjoyed.

In an embodiment the lower edge of the skirt of the cap has a diameter or cross-sectional dimensions that is/are about equal to the respective size of the circumferential wall, e.g. said lower edge occluding the inner space when seen from above.

In an embodiment, when the cap is secured on the neck, the base portion of the tamper-evident ring is arranged in an initial position thereof relative to said circumferential wall. It is then proposed that the base portion of the tamper-evident ring is displaceable from said initial position to a lower position thereof that is deeper downward in said inner space relative to said initial position. The closure assembly is then embodied such that a first time removal of the cap by the user, e.g. involving a rotation of the cap about the main axis, causes said base portion of the tamper-evident ring to be moved to said lower position. This displacement from the initial into the lower position may contribute to the visual evidencing of a first time opening of the cap. In an embodiment, in the initial position thereof, the base portion of the tamper-evident ring protrudes above the circumferential wall, and in the lower position thereof the base portion of the tamper-evident ring does not protrude above the circumferential wall. For example in the lower position a top of the base portion is somewhat below the top of the circumferential wall, which also makes it harder to access the base portion, e.g. in view of the desire to keep the base portion secured on the article.

In an embodiment the closure assembly comprises, in addition to a first or primary snap connection structure between the article and the tamper-evident ring provided by the snap portion and a corresponding window in the wall, at least one auxiliary or secondary snap connection structure that is activated as the base portion of the tamper-evident ring is moved into the lower position thereof and is adapted to retain the tamper-evident ring in the lower position. For example the auxiliary or secondary snap connection comprises a snap ridge positioned at the circumferential wall inner face and possibly also a cooperating snap ridge positioned at the base portion outer face. For example at least one of these secondary snap ridges, e.g. both ridges, extend fully around the circumference of the respective face, which renders it difficult to release said secondary snap connection. It will be appreciated that a secondary snap connection may also or as an alternative be configured between the neck of article and the base portion of the tamper-evident ring. In another embodiment secondary snap connections are envisaged both between the base portion and the circumferential wall, and between the base portion and the neck of the article. Preferably the secondary snap connection is embodied as a permanent snap, with cooperating snap faces substantially perpendicular to the main axis of the article, thereby creating maximum retention of the ring.

In an embodiment one of the cap and the ring comprises at least one cam including a first ramp profile and the other of the cap and the ring comprises at least one cam recess which includes a second ramp profile that is adapted to interact with the first ramp profile of the cam. The cam is positioned between the lower edge of the skirt and the base portion of the tamper-evident ring and is molded to one of the lower edge of the skirt and the base portion of the tamper-evident ring. Preferably, the cam projects from the lower edge of the skirt. The cam recess is positioned opposite the cam at respectively one of the lower edge of the skirt and the base portion of the tamper-evident ring, for example is molded in the base portion. The first and second ramp profiles are angled or inclined with respect to the main axis of the neck of the article. The ramp profiles are inclined with respect to the normal plane of the main axis. Preferably, the ramp profile of the cam recess is substantially parallel to the ramp profile of the cam. The first and second ramp profiles are adapted to interact in order to at least axially displace the tamper-evident ring with respect to the cap. As will be explained this effect can also be used to cause a displacement of the base portion from an initial position to a lower position deeper into the inner space when for a first time rotating the cap to open the closure assembly.

In an embodiment the closure assembly is produced, e.g. by an automated assembly line, in an initial state. The assembly line may comprise an assembly station to interconnect two injection moulded items being the cap with tamper-evident ring and the article to assemble the closure assembly in the initial state. The initial state includes a closed position of the cap on said neck in which the cap has been placed onto the article and in which the product passage is sealed.

In an embodiment, in the initial state of the closure assembly, the tamper-evident ring has been introduced into the inner space of the article over an initial axial depth, e.g. with a top region of the base portion protruding above the circumferential wall and a lower region within the inner space, e.g. said top region being a minor portion of the height of the base portion, e.g. said protruding top region having a height of about 1-3 millimeters above the top of the circumferential wall.

In an embodiment a window is dimensioned such that in said initial position a lower edge of the base portion is spaced above a lower edge or face of the window, so that one can look through the window and see underneath the base portion. Preferably in the lower position the base portion is at least flush with said lower edge or even below said lower edge of the window, e.g. so that the base portion effectively fills the entire window. This visual effect may contribute to the quality of the visual evidence of a first time opening of the cap, in particular when combined with the measure of the top of the base portion initially protruding above the circumferential wall and then in the lower position being hidden behind the wall.

Preferably the depth of the inner space is such that this initial insertion depth of the tamper-evident ring is smaller than an available axial depth of the inner space, so that an axial clearance is present below the annular base portion in the initial position. This clearance allows the tamper-evident ring to be moved deeper into the inner space, to a lower position of the base portion, e.g. to a lowermost position wherein the base portion axially abuts the article.

In an embodiment, when rotating the cap to open the closure, the tamper-evident ring is displaced from an initial position to a lower position due to the interaction of ramp profiles of the cam and the cam recess. The ramp profiles of the cam and cam recess slide relative to each other and force the tamper-evident ring downwards to move from the initial position deeper into the inner space of the article.

It will be appreciated that other arrangements may be provided in the closure assembly that cause the annular base portion of the tamper-evident ring to move deeper into the inner space, or to move upwards, from an initial position upon first time opening of the cap. For example the base member and the circumferential wall are provided with cooperation ramp formations. For example a portion, e.g. upper portion, of the perimeter of a window is embodied as an inclined ramp face with the snap portion of the base portion forming a cooperating ramp formation, wherein, upon rotation of the cap by a user in opening direction, the snap portion slides along said ramp face and is moved thereby in downward direction, e.g. until the underside of the base portion contacts the article body and/or the snap portion is blocked from further rotary motion, so that the base portion is brought into a lower position thereof from a higher initial position. This forced downward motion of the base portion is advantageously used to break or assist in the breaking of the one or more bridges between the cap and the base portion. In such an embodiment, wherein the snap portion in a window not only moves between a higher initial position and a lower position but wherein said lower end position is also offset in rotational direction relative to the initial position a further visual indication is created for the user.

This downward displacement may be visible, e.g. through the at least one window of the article wherein one can observe the relative position of the base portion and/or the snap portion, and/or through the relative position of the top of the base portion relative to the top of the circumferential wall, e.g. in an embodiment a difference between a top region protruding above the circumferential wall and the top base portion being lowered and thereby obscured by said circumferential wall. When the displacement of the tamper-evident ring is observed by a user, the user advantageously has an indication that the closure assembly has been opened and possibly tampered with.

An additional advantage is that the downward displacement of the tamper-evident ring into the inner space further shields the ring in the inner space and contributes in preventing the tamper-evident ring from being released from the article, e.g. by someone chewing on the closure assembly. Preferably, the base portion of the tamper-evident ring has an upper edge which is positioned below a top of the wall after pressing the tamper-evident ring maximally into the inner space. By displacing the tamper-evident ring deeper into the inner space, the inaccessibility of the tamper-evident ring from the outside is further improved.

In an embodiment, a first or primary snap connection between the article and the tamper-evident ring is provided in the initial position by the snap portion on the exterior of the base portion and a corresponding window in the circumferential wall and at least one auxiliary or secondary snap connection is provided between the article and the tamper-evident ring at said lower position, deeper in the inner space, in order to retain the tamper-evident ring at least axially when in said lower position.

In an embodiment the first snap connection is active in the initial state of the closure assembly and a further downward displacement of the base portion within the inner space may still be possible. The base portion then has some freedom to be moved further downward into the inner space in axial direction prior, during, and/or after a breakage of the bridges between the cap and the base portion. The base portion may then be moved, e.g. maximally, down into the inner space. In an embodiment at least one auxiliary or secondary snap connection becomes active as a result of this downward motion and retains the tamper-evident ring in its lower position. Instead of an auxiliary or secondary snap connection one could envisage a frictional retention of the tamper-evident ring in its lower position to limit the freedom of movement of the base portion. In comparison with a frictional retention of the tamper-evident ring at the lower position in the inner space, the auxiliary or secondary snap connection provides a more reliable retention to prevents a later undesired displacement of the tamper-evident ring.

In an embodiment, the first or primary snap connection between the article in the tamper-evident ring in the initial position is provided by the snap portion and a corresponding window in the wall, and the at least one auxiliary or secondary snap connection to snap the tamper-evident ring at a position lower than the initial position is formed by a ridge positioned at the base portion outer face and a wall ridge positioned at the circumferential wall inner face. The ridges are configured to cooperate with each other and advantageously allow the second snap connection in an effective manner.

In an alternative embodiment, the auxiliary snap connection is formed by the snap portion of the base portion and a corresponding snap formation of the circumferential wall behind which the snap portion engages as the ring with the snap portion is moved into the lower position. For example a horizontal spoke extends across the window in the wall and the snap portion is moved from the initial position above said spoke to a lower position below said spoke, wherein the snap portion engages underneath said spoke. A similar structure is create when two windows are provided above one another, with the snap portion first snapping into the first window and then in the lower second window.

In an embodiment the at least one snap portion of the base portion forms a protrusion which extends outward from the base portion outer face and this protruding base portion an inclined bottom face which serves to force, like a wedge, a portion of the circumferential wall elastically outwards when introducing the base portion of the tamper-evident ring into the inner space during assembly of the closure assembly.

Preferably at least a lower section of the neck of the article, which lower section delimits the inner space has a cross-section that corresponds to an inner cross-section of the base portion of the base portion, e.g. with a small or minimal radial play to allow for vertical motion of the base portion between an initial position and a lower position. At least the radial play between the base portion and the lower region of the neck is so small that an inward motion of said at least one snap portion is substantially blocked. The snap effect is thus caused by elastic deformation of a portion of the circumferential wall as the snap portion forces said portion outwards during its introduction into the inner space, which deformed portion of the wall then elastically returns to into its original shape, at least substantially, once the snap portion reaches the window. This snap cannot be undone in this design by pressing the snap portion inward, as the lower region of the neck prohibits such inward motion of the snap portion.

In an embodiment the closure assembly comprises a snap-on type or snap retention type cap. In another embodiment the cap is a screw cap or in yet another embodiment a bayonet type cap.

A snap-on type cap provides the closure assembly with a snap-on functionality, e.g. to allow an easy manual replacement of the cap onto the neck by pressing if the user desires to reclose the passage again. The interior of the skirt of the cap and the exterior of the neck of the article have cooperating snap connector formations, e.g. which are formed by first and second circumferential snap ridges, to provide the snap-on functionality. As is preferred the snap connector formation allow for rotation of the cap relative to the neck.

It is preferred for the tamper-evident ring, at least for the base portion thereof, to be embodied as a continuous ring. This design is likely the sturdiest and most difficult to remove. However, in embodiments, the ring may comprises multiple ring segments in a circular array, e.g. two semi-circular segments, e.g. each semi-circular segment being provided with two snap portions to be mated with two respective windows of the circumferential wall.

The skirt may be ribbed or the like to enhance grip of a user onto the cap, e.g. provided with axial ribbing. In another embodiment the cap comprises one or more grip portions integral to the exterior side of the skirt of the cap to facilitate a user in opening the closure assembly for the first time, e.g. by manually rotating and/or lifting of the cap. Advantageously, the manually rotating of the cap at a first time opening of the closure assembly contributes to an effective breakage of the one or more bridges in between the base portion and the skirt of the cap, while the snap-on type cap subsequently allows a convenient re-placement of the cap onto the neck. In an embodiment the cap is provided with diametrically opposed wing portions to enhance the grip, e.g. as in WO2015/115891. In another embodiment the cap is provided with an outer annular grip portion around and spaced from the skirt, e.g. as disclosed in WO2014/007612.

In an embodiment first and second ramp profiles of the cap and the base portion define a total stroke 'st' of an axial displacement of the tamper-evident ring with respect to the skirt of the cap. At the same time the base portion may be displaceable downward from an initial position relative to the circumferential wall over a stroke 's', e.g. till the base portion lower edge abuts the article, wherein said stroke 's' is smaller than the total stroke 'st' afforded by the cooperating ramp profiles. This design is in particular useful in combination with a snap-on retention of the cap onto the neck, as a first time rotation of the cap by the user will then first cause the base portion to move down to the lower position thereof due to a first phase of interaction of the ramp profiles, with the snap connection between the cap and the neck remaining active, and further rotation will then cause the cap to be lifted relative to the base portion due to the second phase of interaction of the ramp profiles, thereby assisting in the release of the snap connection between the cap and the neck.

In an embodiment the tamper-evident ring is retained in its lower position by a secondary snap connection, e.g. a ridge on the exterior of the base portion cooperating with a ridge on the interior of the circumferential wall.

In an embodiment, the closure assembly comprises cooperating ramp profiles on the skirt and the base portion respectively which are adapted to, upon first time opening of the closure assembly by rotation of the cap by a user, first cause the base portion to be pushed deeper into the inner space from an initial position thereof into a lower position and then cause the cap to be lifted, e.g. said lifting assisting in the release of a snap connector fitting between the cap and the neck and/or the breaking of the one or more breakable bridges between the base portion and the skirt.

In an embodiment, the wall comprises at least one pair of windows including a first and second window. The first and second windows are positioned in the wall diametrically opposite each other. This may apply e.g. for articles, e.g. spouts, with a small diameter product passage and neck, e.g. a diameter between 3 and 5 millimeter.

In an embodiment each window has a top face and a bottom face, e.g. parallel faces, e.g. horizontal faces.

In an embodiment at least one of a top face and a bottom face of a window in the circumferential wall is embodied as a ramp that is adapted to cause vertical motion of the tamper-evident ring with respect to the circumferential wall during first time opening of the cap in an embodiment wherein said opening causes the ring to rotate about the neck and relative to the stationary circumferential wall. The motion of the ring can be a downward motion, e.g. from an initial position wherein a top portion of the ring protrudes above the circumferential wall to a lowered position wherein the ring is substantially hidden below the top of the circumferential wall, or an upward motion, e.g. to cause the ring to become visible above the circumferential wall from an initial hidden position.

In an embodiment it is envisaged that the presence of a pair of opposed windows in the circumferential wall is used in the course of conveyance and/or manipulation of the article, the assembled closure assembly, and/or a container provided with the article and/or closure assembly.

The invention envisages a method wherein the article, or a container provided with the article, is handled by a manipulator device, wherein the manipulator may have one or more manipulator members engaging in one or more of the windows, e.g., when fitting, e.g. by heat sealing, the article to a container, e.g. even when the cap has been applied and a snap portion is present in a window. For example the invention provides a heat sealing method and heat sealing device, wherein the non-capped or even capped article is held by a manipulator having one or more manipulator members engaging in one or more windows to retain the article during a heat sealing step, wherein the article is heat sealed onto a container.

The invention envisages a method wherein the article, or a container provided with the article, is conveyed, for example in an assembly or production line, and wherein a conveyor device has spaced apart conveyor guides, e.g. guide rails, Herein beneficial use may be made of the presence of a pair of windows in that a respective guide, guide rail, fits partially into a window allowing the article to slide over the guide, e.g. guide rails. For example this can be done with the article having been fitted onto a flexible pouch container.

Seen from aside, the presence of the pair of windows in the wall of the article may provide locally a reduced diameter at the wall of the article. In assembling the closure assembly, it may be advantageous to use this locally reduced diameter as a guidance or an engagement position to convey or guide the article in the normal plane. An assembly-tool, like a rail, may be used to handle the article and may engage the article at the reduced diameter. Advantageously, such an engagement of an article may be stable at high production speeds in a mass production.

In an embodiment the circumferential wall has four windows in total. Preferably, the four windows are distributed along the circumference of the wall. The four windows are preferably equally spaced along the wall. Preferably, the wall comprises two pairs of windows in which each pair of windows includes two windows which are positioned diametrically opposite each other. It will be appreciated that release of four snap portion from four windows is very difficult, in particular if, as preferred, each of said snap portions forms a permanent snap with a corresponding face or edge of the window.

Advantageously, the closure assembly may be guided or engaged in two perpendicular directions in the normal plane of the main axis by engaging the guidance surfaces formed by the pairs of windows. This may further improve a reliability of an assembly or production line.

In an embodiment, the article is a spout to be secured to a collapsible pouch container. For example the spout comprises a lower connector portion, e.g. of circular or boat shaped cross-section, that is adapted for heat sealing the spout between opposed film walls of a collapsible pouch container, or as a radial flange portion adapted to be sealed onto a panel or wall of the container. The lower connector portion to be sealed between opposed film walls may include two fins that extend in opposite directions from a central tubular part of the lower connector portion. The fins may extend in a perpendicular direction with respect to an imaginary line crossing a pair of windows in the circumferential wall, e.g. such that the guidance surfaces provided by the pair of windows are accessible from the outside by a manipulator tool e.g. of a heat sealing station, or a tool of an assembly line, or a tool of production line, e.g. a filling tool.

In an embodiment, the at least one snap portion forms a wedge shaped protrusion. The protrusion extends outwardly from the base portion outer face. The protrusion is wedge shaped in a longitudinal sectional view through the main axis. The wedge shaped snap portion has an inclined bottom face which serves to guide the tamper-evident ring with respect to the article when introducing the ring into the inner space of the article and/or to force the circumferential wall a bit elastically outward in assembling the closure assembly. The wedge shaped snap portion has an axial stopper face at the top which serves as an axial stopper after snapping the snap portion into the window in the wall of the article in assembling the closure assembly. As is preferred this stopper face and the corresponding face or edge of the window are embodied to form a permanent snap, e.g. said faces extending substantially perpendicular to the main axis. As is discussed the snap portion may also include a side stopper face that acts to block or limit rotational motion of the base member relative to the article.

Preferably, the upper stopper face is formed by a flat plane which is preferably oriented in parallel with a normal plane of the main axis. The snap portion may have one or a pair of side faces, at least one of which serves as a stopper face for the tamper-evident ring in a rotational direction about the main axis. The at least one side stopper face may be oriented perpendicular to the upper stopper face. In an embodiment the side faces are each oriented in a plane extending through the main axis. By blocking a rotational movement of the tamper-evident ring, the bridges in between the skirt and the base portion can be broken when manually rotating the skirt of the cap. As discussed the rotational retention can also be achieved in other manners.

Advantageously the first or primary snap connection may be obtained in an assembly line by means of an automated assembly station. During assembly, the cap is placed onto the article, e.g. by axial pressing, and the tamper-evident ring is introduced into the inner space in a controlled manner. In the process the at least one snap portion of the tamper-evident ring is snapped into a corresponding window by exerting an assembly force in a controlled manner.

In an embodiment the closure assembly comprises a screw-type cap. The cap comprises a top wall and a downward depending skirt. The skirt has an interior side, exterior side and a lower edge remote from the top wall. The exterior side of the neck and the interior side of the skirt have co-operating first and second screw threads on said neck and skirt respectively. In embodiments the screw threads are embodied to allow for the cap to be pressed axially onto the neck, with the user then rotating the cap for opening of the closure assembly. Such press-fit connectable screw threads are known in the art.

In an embodiment the article is a fitment to be secured to a container body. The article may be a spout having a lower connector portion to be secured between opposed film walls of a collapsible pouch container. In particular, the spout may have a lower connector portion with two fins extending in opposed directions. The article may be a spout having a lower circumferential plate portion to be welded onto a panel of a container like a carton or the side wall of a collapsible pouch container.

Further, the invention relates to a container provided with a closure assembly according to the invention, e.g. a collapsible pouch container, a carton, a plastic bottle, etc.

Further, the invention relates to a method for manufacturing and filling such a container, comprising the steps of providing a container, providing the article, filling the container, e.g. via a product passage of the article and placing the cap on to the neck of the article. The cap is placed on the neck of the article, such that the cap seals the product passage in a closed position of the cap on said neck. Further, the base portion is introduced into the inner space of the article. The introduction activates a snap connection between the base portion and the article by snapping the snap portion positioned on a base portion outer face into a window in the wall of the article.

In a second aspect, the invention relates to a closure assembly comprising an article and a cap including a tamper-evident ring, wherein:

the article is moulded of a plastic material and forms a tubular neck around a product passage in said article, said neck having a main axis and forming a mouth at a top end of said product passage, wherein the article further comprises a circumferential wall which wall is positioned around a bottom region of the neck and spaced from the neck to form an inner space which is open from above and adapted to receive the tamper-evident ring, the cap is moulded of a plastic material and is secured on or is to be secured on said neck of the article, the cap sealing the product passage in a closed position of the cap on said neck, and the cap being adapted to be manually removed, wherein the cap comprises a top wall and a downward depending skirt, said skirt having an interior side, an exterior side, and a lower edge remote from the top wall, wherein the tamper-evident ring is integrally moulded to the lower edge of the skirt of the cap, said tamper-evident ring comprises an annular base portion which is connected via one or more breakable bridges to the skirt, which annular base portion is provided with at least one snap portion adapted to snap the base portion to the article, said at least one snap portion axially retaining the base portion with respect to the neck, such that the tamper-evident ring remains on the article and that the bridges break when the user removes the cap, e.g. involving a rotation of the cap, wherein the base portion of the tamper-evident ring has a base portion outer face and a base portion inner face, wherein the at least one snap portion is positioned at the base portion outer face, wherein the wall of the article comprises at least one snap formation which is complementary to the snap portion of the base portion, e.g. a window, a recess in the inner face of the circumferential wall, e.g. a recessed aperture or a circumferential groove, wherein the at least one snap portion is adapted to mate with the complementary snap formation of the wall to snap the tamper-evident ring to the article when the tamper-evident ring is inserted in the inner space.

It will be appreciated that in this second aspect the complementary snap formation may be embodied different than a window through the wall, e.g. by a recess at the inside of the circumferential wall having sufficient depth to obtain a snap engagement with the snap portion. This may require, e.g. locally, an increased, thickness of the circumferential wall, compared to a design wherein a window extends through the wall.

In an embodiment according to this second aspect of the invention, the at least one snap portion is formed by a ridge extending along the base portion outer face, e.g. around substantially the whole circumference of the base portion. Substantially means that the ridge may be interrupted locally e.g. by a cam recess. In assembling the cap with the tamper-evident ring to the article, the circumferential ridge may be snapped into a corresponding groove or behind a corresponding ridge at the wall inner face of the wall of the article, such that an axial release of the tamper-evident ring is prevented. Several circumferential ridges forming several snap portions may be provided above each other. The at least one ridge at the base portion outer face snaps and engages to the circumferential wall of the article. At least one wall ridge may be provided to snap above or in between several ridges provided at the base portion outer face. The ridge cooperation provide an axial blockage of the tamper-evident ring, but still allow a rotational movement. The axial blockage may sufficient to break the bridges in between the skirt and base portion of the cap.

In an embodiment the closure assembly comprises a screw type cap to provide in use a screw on functionality. The interior side of the skirt of the cap and exterior side of the neck of the article have co-operating connector formations. The co-operating connector formations comprise a first and second screw thread on said neck and skirt respectively.

As according to an embodiment of the second aspect of the invention a rotational retention of the tamper-evident ring with respect to the article may be omitted, screw type co-operating connector formations between the cap and the neck may serve to break the one or more breakable bridges between the skirt of the cap and the base portion of the tamper-evident ring.

In an embodiment, the skirt of the cap and the ring may comprise at least one cam and at least one cam recess including respectively an interacting first and second ramp profile in order to axially displace the tamper-evident ring with respect to the article from an initial position when for a first-time rotating the cap with respect to the article. The ramp profile is angled with respect to the main axis and positioned at one of the lower edge of the skirt and the base portion of the tamper-evident ring. A pitch of the screw-type co-operating connector formations, i.e. the first and second screw thread, is larger than a pitch of the ramp profiles, such that the tamper-evident ring is pressed downwards when rotating the cap relative to the article.

Further embodiments according to the second aspect are defined by the dependent claims and/or other features, including optional features, as presented herein in relation to the first aspect of the invention. For example the base portion may be mobile between the mentioned initial position and a lower position deeper in the inner space.

In a third aspect, the invention relates to a closure assembly comprising an article and a cap including a tamper-evident ring, wherein:

the article forms a tubular neck around a product passage in said article, said neck having a main axis and forming a mouth at a top end of said product passage, wherein the article further comprises a circumferential wall which wall is positioned around a bottom region of the neck and spaced from the neck to form an inner space which is open from above and adapted to receive the tamper-evident ring, the cap is secured on or is to be secured on said neck of the article, the cap sealing the product passage in a closed position of the cap on said neck, and the cap being adapted to be manually removed from the closed position in an opening direction, wherein the cap comprises a top wall and a downward depending skirt, said skirt having an interior side, an exterior side, and a lower edge remote from the top wall, wherein the tamper-evident ring is integrally moulded to the lower edge of the skirt of the cap, said tamper-evident ring comprising base portion which is connected via one or more breakable bridges to the skirt, which base portion is provided with at least one snap portion adapted to snap the base portion to the article, at least to retain the base portion axially with respect to the article, such that the tamper-evident ring remains on the article and the one or more bridges break when the user removes, e.g. rotates, the cap, wherein the base portion of the tamper-evident ring has a base portion outer face and a base portion inner face, wherein the at least one snap portion is positioned on the base portion outer face to cooperate with a complementary snap formation of the circumferential wall or on the base portion inner face to cooperate with a complementary snap formation on the neck, wherein the at least one snap portion of the base portion cooperates to engage with the complementary snap formation to snap the tamper-evident ring to the article when the tamper-evident ring is inserted into the inner space.

Further embodiments according to the third aspect are defined by the dependent claims and/or other features, including optional features, as presented herein in relation to the first or second aspect of the invention.

For example the third aspect includes an embodiment wherein the windows in the circumferential wall are absent and/or wherein the snapping is located at the inside of the base member instead of in a window. For example in such embodiment the base portion is mobile between an initial position and a lower position as disclosed herein.

In a fourth aspect, the invention relates to a closure assembly comprising an article and a cap including a tamper-evident ring, wherein:

the article forms a tubular neck around a product passage in said article, said neck having a main axis and forming a mouth at a top end of said product passage, wherein the article further comprises a circumferential wall which wall is positioned around a bottom region of the neck and spaced from the neck to form an inner space which is open from above and adapted to receive the tamper-evident ring, the cap is moulded of a plastic material and is secured on or is to be secured on said neck of the article, the cap sealing the product passage in a closed position of the cap on said neck, and the cap being adapted to be manually removed from the closed position in an opening direction, wherein the cap comprises a top wall and a downward depending skirt, said skirt having an interior side, an exterior side, and a lower edge remote from the top wall, wherein the tamper-evident ring is provided to the lower edge of the skirt of the cap, said tamper-evident ring comprises an annular base portion which is connected via one or more breakable bridges to the skirt, which annular base portion is provided with at least one snap portion adapted to snap the base portion to the article, the at least one snap portion comprises an upper stopper face which is arranged to block an axial movement of the base portion with respect to the neck, such that a once snapped tamper-evident ring remains on the article and that the bridges break when the user rotates the cap, wherein the base portion of the tamper-evident ring has a base portion outer face and a base portion inner face, wherein the at least one snap portion is positioned on the base portion inner face, wherein the neck of the article comprises at least one snap formation which is adapted to cooperate with the snap portion on the base portion, e.g. a recess, e.g. opposite a window in the circumferential wall, or a groove around the neck, wherein the at least one snap portion is adapted to engage with the complementary snap formation of the neck when the tamper-evident ring is introduced into said inner space and/or further lowered in said inner space from an initial position.

Further embodiments according to the fourth aspect are defined by the dependent claims and/or features, including optional features, as presented herein in relation to the first or any other aspect of the invention.

The invention also relates to a spout adapted to be secured to a container, e.g. a collapsible pouch container, wherein:

the spout is moulded of a plastic material, e.g. as a one piece plastic item, wherein the spout has a lower connector portion that is adapted to be secured or secured between opposed film walls of a collapsible pouch container or to be secured or secured onto a panel of a container, and wherein the spout has, above the lower connector portion, a tubular neck around a product passage in said spout, said neck having a main axis and forming a mouth at a top end of said product passage, wherein the spout further comprises a circumferential wall which is positioned around a bottom region of the neck and is spaced from the neck forming an inner space which is open from above and adapted to receive therein a tamper-evident portion, e.g. a tamper-evident ring, of a cap which is secured on or is to be secured on said neck of the article, the cap sealing the product passage in a closed position of the cap on said neck, and the cap being adapted to be manually removed from the neck of the article by a user to open the product passage, wherein the circumferential wall of the article comprises at least one window which extends through said wall from a wall outer face to a wall inner face.

The above spout may further include one or more of the technical features as disclosed herein with respect to one or more aspects of the invention, e.g. having one or more windows therein, each window being adapted to retain therein a snap portion of a tamper-evident ring and/or having a snap ridge along the inner face of the circumferential wall to retain a tamper-evident ring, e.g. in a lowered position thereof.

The present invention also relates to the combination of a spout as above and a cap which is secured on or is to be secured on the neck of the spout, the cap sealing the product passage in a closed position of the cap on said neck, and the cap being adapted to be manually removed from the neck of the article by a user to open the product passage. For example the cap has a tamper-evident ring that is received or adapted to be received at least partially in said space between the circumferential wall and the neck of the spout.

The present invention also relates to a collapsible pouch provided with a closure assembly or spout as disclosed herein, either with or without the cap.

The invention will now be explained with reference to non-limiting embodiments of the closure assembly as shown in the drawings. In the drawings.

In the appended figures, the closure assembly according to the invention is illustrated. Now, with a reference to FIGS. 1-3, a first embodiment of a closure assembly according to the invention will be discussed.

The assembly is generally composed of two separate plastic items, namely an article 1, here embodied as a spout and a cap 2 which includes a tamper-evident ring 3.

Figure 1A:
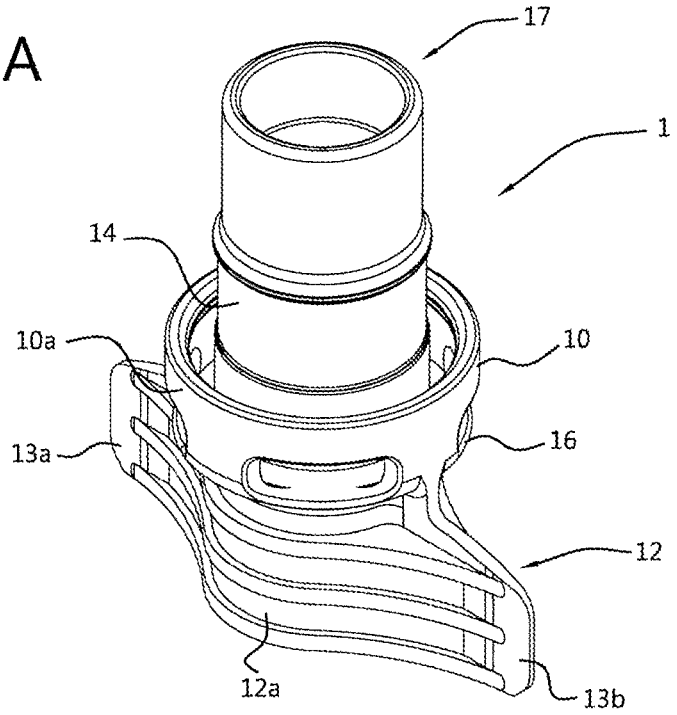
FIG. 1A shows a perspective view of a spout of a closure assembly as shown in FIG. 3.
Figure 2A:
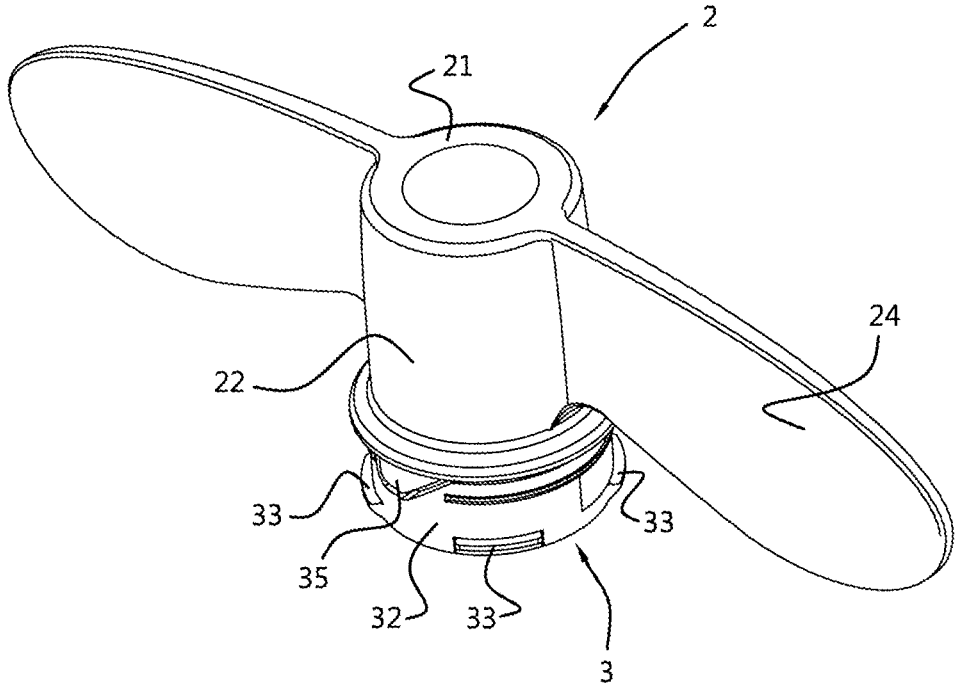
FIG. 2A shows a perspective view of a cap of the closure assembly as shown in FIG. 3.

The embodiment of the closure assembly comprises a spout 1 as shown in FIG. 1A and a cap 2 as shown in FIG. 2A. As is preferred, the spout 1 is manufactured by injection moulding as a one piece item in a mould.

Here, the spout 1 is adapted to be secured with a lower connector portion 12 thereof between opposed film walls of a collapsible pouch container. The lower connector portion 12 is preferably heat sealed between opposed film walls of a pouch container. Such techniques are known in the art. The lower connector portion 12, as is preferred, here includes two fins 13*a*, 13*b* that extend in opposite directions from a central tubular part 12*a* of the lower connector portion 12. These fins 13*a*, 13*b* lie in a common imaginary vertical plane. The central part 12*a* here is essentially circular in horizontal cross-section but other shapes, e.g. oval, elliptical, etc., are also possible.

The spout 1 forms, here above the lower connector portion 12, a tubular neck 14 around a product passage 15 in the spout. As is known, the passage 15 extends through the lower connector portion 12 to one or more lower openings 18. The figures relate to a design wherein the passage 15 has a diameter of about 8 mm.

The neck 14 as an exterior side that may be provided with screw thread formations, e.g. a double screw thread formations as is preferred to provide two 180° angularly offset starting positions for the cap 2. Here, the closure assembly is configured as a snap-closure in which no screw threads are provided. In a middle region, the neck 14 comprises a snap ridge 19 for snapping the cap 2 onto the article.

Figure 1B:
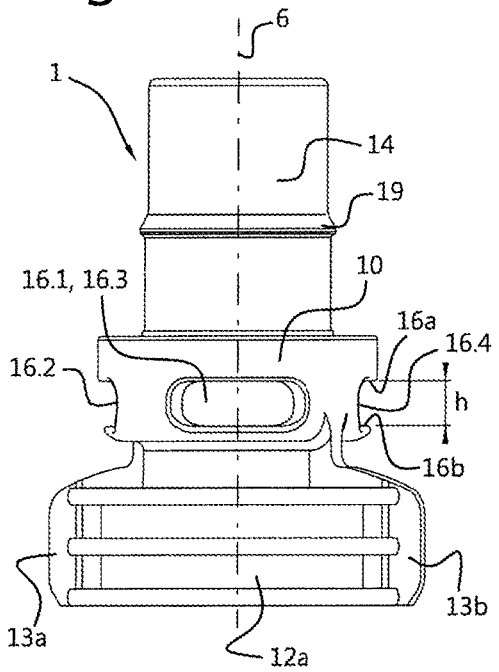
FIG. 1B shows a front view of the spout from FIG. 1A.
Figure 1C:
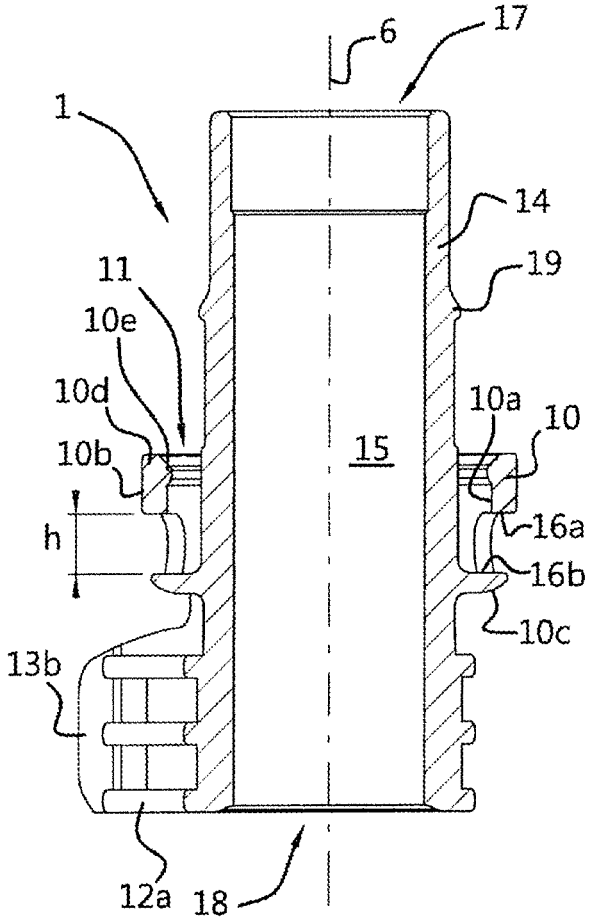
FIG. 1C shows a sectional view in a longitudinal direction about a main axis of the spout.

As shown in further detail in FIGS. 1B and 1C, the spout 1 comprises an annular inner space 11 at a bottom region of the tubular neck 14. The inner space 11 is formed by the tubular neck 4 and a circumferential wall 10. The wall 10 extends in parallel with the tubular neck 14. The wall 10 is spaced apart from the tubular neck 4. The inner space is open from above for receiving the tamper-evident ring 3 of the cap 2. The wall circumferences a bottom region of the neck 4. The wall 10 extends in a circumferential direction about a main axis 6. The wall 10 has an outer wall face 10*a* and an inner wall face 10*b*. The wall 10 extends in axial direction.

The wall 10 has a predetermined wall height and extends from a wall base 10*c* upwards to a wall top 10*d*. The wall base 10*c* is connected to the tubular neck 14. The wall base 10*c* delimits a lower region of the inner space 11. The wall top 10*d* delimits an upper region of the inner space 11. The inner space 11 has a height which substantially equals a height of the tamper-evident ring 3. Preferably, the height of the inner space 11 is about 10% larger than the height of the tamper-evident ring 3, such that the tamper-evident ring 3 can be fully received by the inner space 11. At the wall top 10*d*, the wall 10 comprises a wall ridge 10*e* which is positioned at the inner wall face 10*b*. The wall ridge 10*e* is shown in FIG. 10. The wall ridge 10*e* is positioned adjacent to an upper edge of the wall 10. Here, the wall ridge 10*e* extends as a single feature along the circumference of the wall 10, but alternatively, the wall ridge 10*e* may be featured by several wall ridge segments. The wall ridge 10*e* is configured for snapping with a corresponding ridge 37 of the cap 2, which will hereafter be further elucidated by reference to FIG. 3E.

The wall 10 comprises at least one receiving feature, like an aperture, groove or ridge for receiving a snapping feature of the tamper-evident ring 3. The aperture may have a predetermined depth, but preferably as shown here, the aperture is a through aperture, also called a window 16, more particularly a viewing window. The at least one aperture is open from the inner wall face 10*a* to the outer wall face 10*b*. The window 16 is configured to snap the cap 2 to the spout 1. The window 16 is configured to receive a snap portion 33 at the tamper-evident ring 3 of the cap 2. The snap portion 33 has a predetermined width which fits inside the window 16. Advantageously, the window 16 makes an engagement of a snap portion 33 of the tamper-evident ring 3 visible from the outside.

Here, the wall 10 comprises four windows 16.1, 16.2, 16.3, 16.4 which are equally distributed about the circumference of the wall 10. Preferably, the wall 10 comprises at least one pair of windows 16.1, 16.3; 16.2, 16.4 including a first and second window positioned diametrically opposite each other. Seen from above, the first and second window are positioned in mirror symmetry.

Each window 16 of such a pair of windows has a predetermined height and width. As shown in FIGS. 1B and 1C, the predetermined height 'h' of the window 16 provides a first and second guidance surface 16*a*, 16*b*. These guidance surfaces 16*a*, 16*b* can be used by a rail-tool during manufacturing of the article 1 for conveying the article from one station to another or during assembly in an assembly line. The outer wall face 10*b* is a smooth-surfaced cylinder. Advantageously, in comparison with other similar articles, the outer wall face 10*b* can remain free of guiding ridges or added flanges which allows a minimisation of plastic material to produce this article 1.

As shown in FIGS. 1A-1C, the article is a spout. The spout comprises the lower connector portion 12 for heat sealing the spout between opposed film walls of a collapsible pouch container. The lower connector portion includes two fins 13*a*, 13*b* that extent in opposite directions from a central tubular part 12*a* of the lower connector portion. The fins 13*a*, 13*b* extend in a perpendicular direction with respect to an imaginary line crossing the pair of windows 16.1, 16.3, such that the guidance surfaces provided by the pair of windows are accessible from the outside by a guidance tool of the assembly or production line.

The closure assembly further comprises a cap 2 which is shown in FIG. 2A-2D. The cap 2 is adapted to be secured onto the neck 14, which can be done in an assembly line to manufacture pre-assembled assemblies as shown in FIG. 3A. Such a pre-assembled closure assembly can be attached to an already filled pouch container. The cap 2 can also be delivered separately from the spout 1 to e.g. a company producing filled pouches. For example, the spout 1 is sealed into a pouch, the pouch is filled via the passage 15 and then the cap 2 is placed on the neck 14 by an automatic cap screwing device. In another example, a pouch is filled, the spout 1 is sealed into the filled pouch and then the cap 2 is place on the neck 14. In another example, the spout 1 is preassembled with the cap 2 and as a pre-assembly sealed into a pouch, wherein the pouch may be filled beforehand or via a pouch opening or initial open sew at a bottom region of the pouch.

Figure 3A:
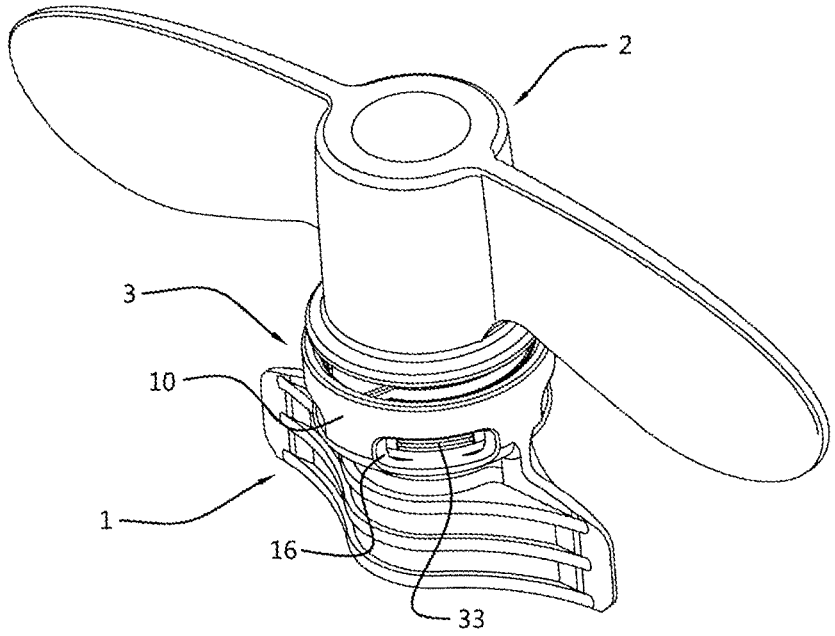
FIG. 3A shows in a perspective view a closure assembly including the spout and cap as shown in FIG. 1 and FIG. 2 in which the closure assembly is shown in an initial-state, in which the spout and cap are positioned relative to each other in a manner as how they are initially connected to each other.
Figure 3B:
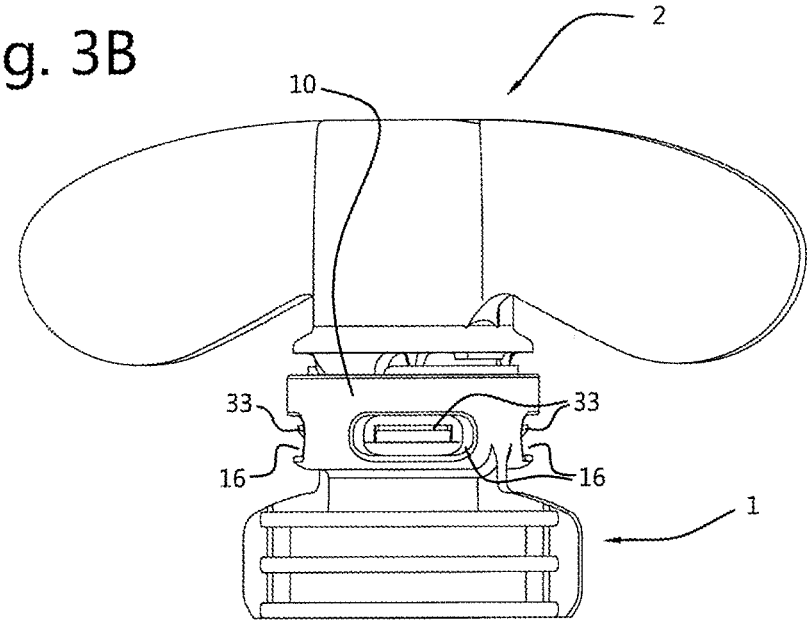
FIG. 3B shows a front view of the closure assembly as shown in FIG. 3A.

The cap 2 seals the product passage 15 in a closed position of the cap on the neck as shown in FIGS. 3A and 3B.

Figure 3C:
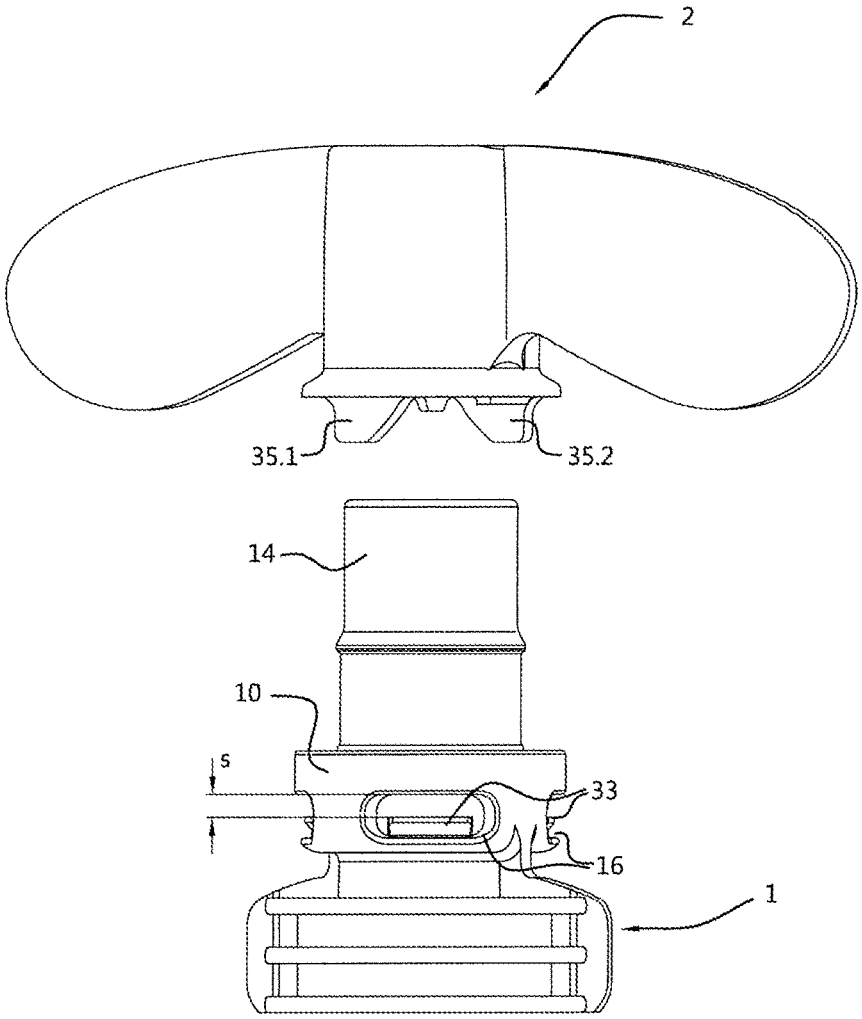
FIG. 3C shows an exploded view in a longitudinal direction about a main axis of the closure assembly of FIG. 3B.

For removal of the cap 2 from the neck 14 by a user to open the product passage 15, a user manually rotates the cap from the closed position in an opening direction, here counter clockwise as is preferred. The closure assembly in an open position is shown in FIG. 3C.

As shown in FIG. 2A, the cap 2 comprises a top wall 21 and a downward depending annular skirt 22. The cap 2 is a hollow item. The cap 2 is cylindrically shaped and has an inner space 25. The skirt has an interior side, exterior side and a lower edge remote from the top wall 21.

The interior side of the skirt may be provided with screw thread formations that cooperate with the screw thread formations on the neck 14 of the spout 1. Here, the cap 2 is arranged as a snap-closure.

At a middle region, the interior side of the skirt 22 is provided with a snap ridge 23 for snapping the cap 2 onto the spout 1. The snap ridge 23 of the cap interacts with the snap ridge 19 at the middle region of the neck 14 of the spout.

The exterior side of the skirt 22 is provided with a grip for manually operating the closure assembly. Here, the grip includes two opposite positioned wing shaped handles which despite the provided snap-closure arrangement stimulates a user to rotate the cap 2 from the spout 1.

Figure 2B:
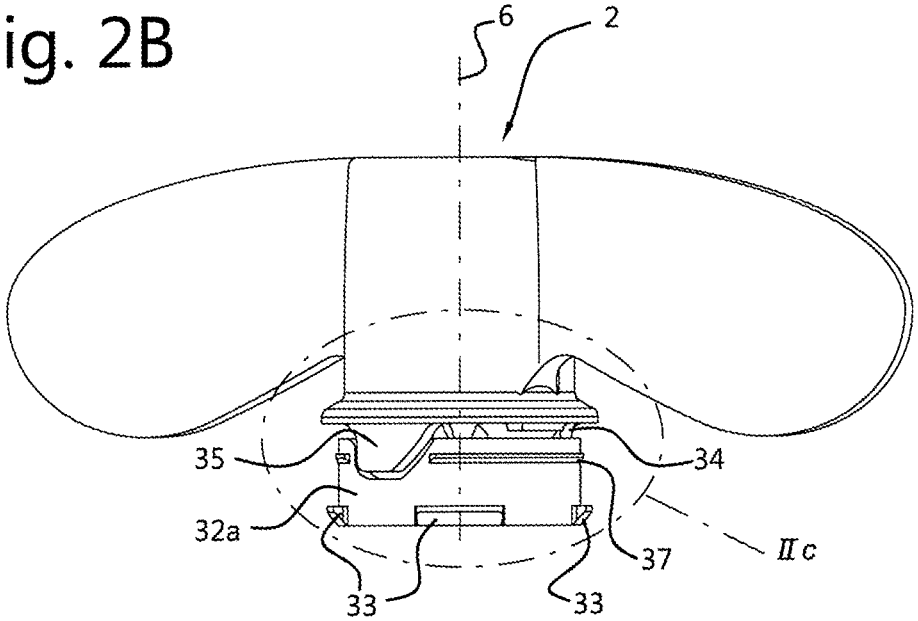
FIG. 2B shows a front view of the cap with a tamper-evident ring as shown in FIG. 2A.

As further shown in FIGS. 2A and 2B, the cap 2 comprises a tamper-evident ring 3 that is integrally moulded to the skirt 22. Here, the tamper-evident ring 3 is composed of a single ring element. The ring element extends about a main axis 6. The ring element has a base portion 32 and at least one snap portion 33 at an outer face 32*a* of the base portion.

The base portion 32 is connected via one or more breakable bridges 34 to the skirt 22. Here, the base portion 32 is provided with four bridges 34 to provide an initial connection of the tamper-evident ring 3 to the skirt 22 of the cap 2. The bridges 34 are formed by small injection moulded bridges in between the skirt 22 and the base portion 32 of the tamper-evident ring 3. Before use of the closure assembly, the tamper-evident ring 3 is connected to the cap 2 by the breakable bridges 34. When in use removing the cap 2 from the closure assembly, the bridges 34 break and the tamper-evident ring 3 is left attached to the spout 1.

Further, the lower edge of the skirt 22 of the cap 2 is provided with supporting bosses 34*b* which support a downwards pressing of the tamper-evident ring 3 into the inner space 11 of the article and which bosses 34*b* contribute to prevent a too early breaking of the bridges 34.

The attachment of the tamper-evident ring 3 to the article 1 is provided by the at least one snap portion 33. The at least one snap portion 33 is integrally moulded with the base portion 32. The snap portion 33 forms a protrusion which outwardly extends from the outer face of the base portion 32. The snap portion 33 engages and snaps with a complementary designed feature of the article 1 which is here a window 16 to provide a connection between the tamper-evident ring 3 and the article 1.

Figure 2C:
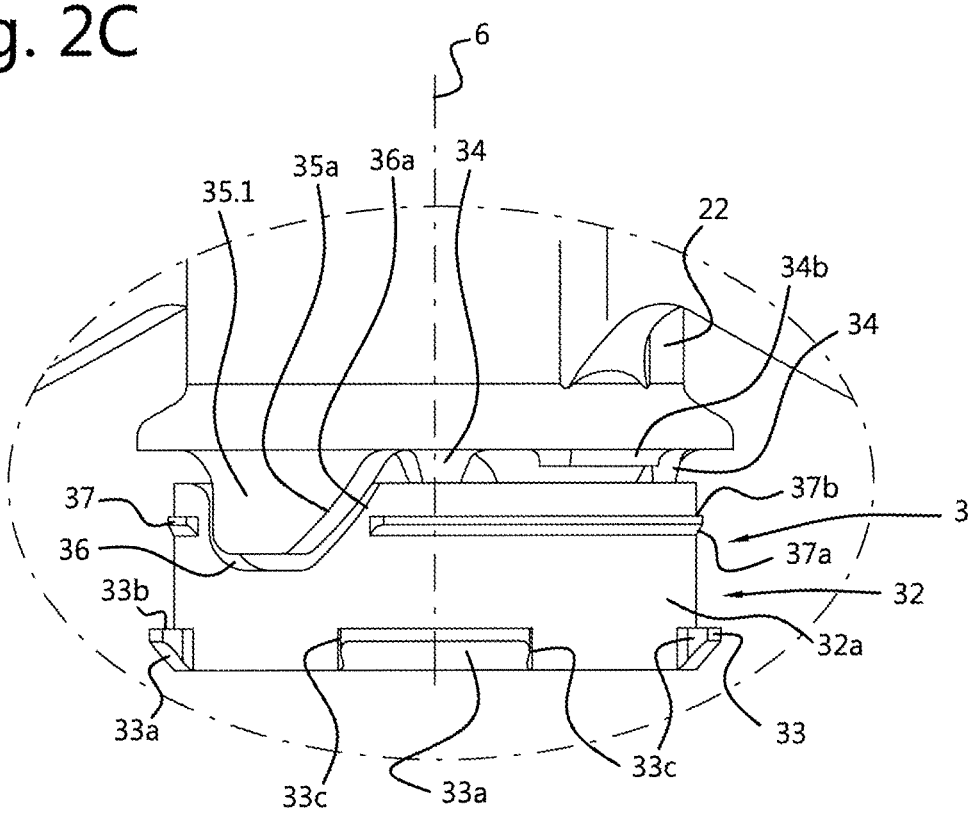
FIG. 2C shows an enlarged view of the tamper-evident ring of FIG. 2B.

As shown in FIG. 2C, in a longitudinal sectional view along the main axis 6, the snap portion 33 is wedge shaped. The wedge shaped snap portion 33 has an inclined bottom face 33*a* which serves for centring the tamper-evident ring 3 with respect to the article 1 when placing the ring 3 onto the article 1 in assembling the closure assembly. The wedge shaped snap portion 33 has an upper stopper face 33*b* which serves as a stopper when snapping the snap portion 33 into the window 16 of the article 1 in assembling the closure assembly. The wedge shaped snap portion 33 has a side stopper faces 33*c* which serve as a stopper for the tamper-evident ring 3 in a rotational direction about the main axis 6. In assembling the tamper-evident ring 3 to the article 1, the upper stopper face 33*b* limits an axial movement of the tamper-evident ring 3 with respect to the article 1. In assembling the tamper-evident ring 3 to the article 1, the side stopper face 33*c* limits a rotational movement of the tamper-evident ring 3 with respect to the article 1 which is further shown in FIG. 3B. Herewith, the tamper-evident ring 3 is coupled to the article 1.

As further shown in FIG. 2C, the cap 2 is provided with at least one cam 35. The cam 35 is positioned in between the skirt 22 and the bottom portion 32 of the tamper-evident ring 3. Here, as preferred, the cam 35 is integrally moulded with the cap 2. Alternatively, the cam 35 may be integrally moulded with the base portion 32 of the tamper-evident ring.

The cam 35 is formed as a tooth. The cam 35 downwardly extends from a lower edge of the skirt 22. In an upper region, the base portion 32 of the tamper-evident ring 3 comprises a cam recess 36 which is complementary shaped to the cam 35. The recess 36 is positioned at the upper edge of the base portion 32.

Figure 2D:
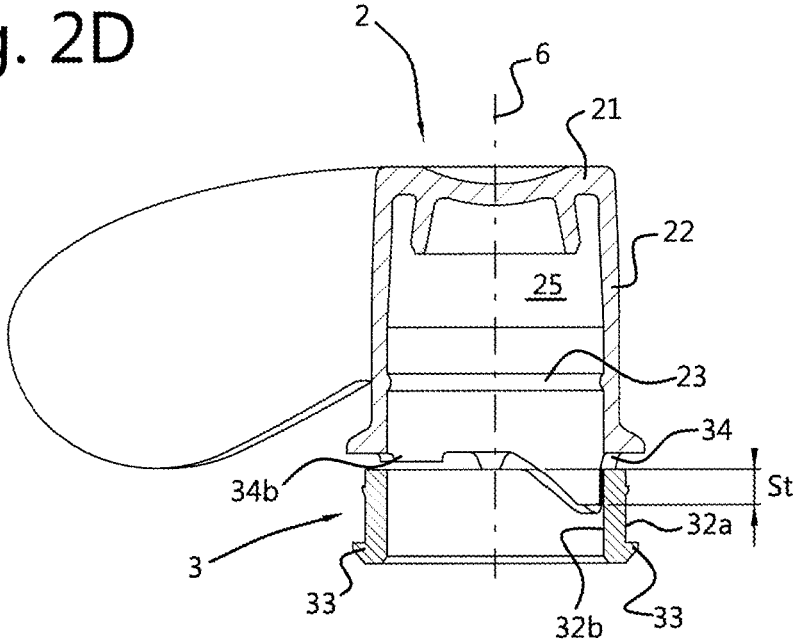
FIG. 2D shows a sectional view in a longitudinal direction about a main axis of the cap.

The cam 35 and the recess 36 each comprise a ramp profile 35*a*, 36*a* which are complementary to each other. The cam 35 comprises a first ramp profile 35*a*. The cam recess 36 comprises a second ramp profile 36*a*. Each ramp profile has an inclined face with respect to a normal plane of the main axis 6. The ramp profiles 35*a*, 36*a* serve to generate an axial movement of the tamper-evident ring 3 when rotating the above positioned skirt 22 of the cap 2 about the main axis 6. When in use rotating the cap 2, the bridges 34 will break and the cam 35 will engage to the base portion 32 of the tamper-evident ring 3. The engagement of the cam 35 will exert an axial force to the tamper-evident ring 3 which will cause a downwardly directed movement of the tamper-evident ring 3 with respect to the article 1. As indicated in FIG. 2D, the relative movement between the cap 2 and the tamper-evident ring 3 includes a total stroke 'st' determined by a height of overlapping of the ramp profiles 35*a*, 35*b*.

As further shown in FIG. 2C, the tamper-evident ring 3 comprises a ridge 37. The ridge 37 serves to snap fit the tamper-evident ring 3 at a lower position to the article 1 to indicate a used-state.

As is preferred, the ridge 37 is wedge shaped. The wedge shaped ridge 37 has an inclined bottom face 37*a*, which contributes to a snapping of the ridge 37 to the article 1. The ridge 37 has an upper stopper face 37*b* which serves as a stopper after snapping the ridge 37 to the article 1. The upper stopper face 37*b* limits a upwards movement of the tamper-evident ring 3 after being positioned in the lower position. This is further illustrated in FIG. 3E.

The ridge 37 extends along the outer face 32*a* of the base portion 32 in a circumferential direction about the main axis 6 in the normal plane of the main axis 6. Here, the ridge 37 is formed as a single feature extending along the outer face 32*a*, but alternatively the ridge 37 may comprise a plurality of ridge segments. The ridge 37 may extend along the full outer circumference of the base portion 32. Here, the ridge 37 is positioned at the upper region of the base portion and interrupted by the recess 36. The ridge 37 has a first and second end which are positioned adjacent both lateral sides of the recess 36.

FIG. 2D shows a longitudinal sectional view about a main axis 6 of the cap 2 including the tamper-evident ring 3. The tamper-evident ring 3 is connected to the skirt 22 of the cap 2 by the tiny bridge shaped bridges 34. The cap 2 including the tamper-evident ring 3 is manufactured as a one piece item by injection moulding.

The base portion 32 of the tamper-evident ring 3 has a base portion inner face 32*b*. The inner face 32*b* is formed as a circumferential flat plane. The inner face 32*b* is a smooth-surfaced cylinder. The inner face 32*b* is free from any protrusions.

FIG. 2D and FIG. 3C further show a presence of multiple cams 35. Here, the cap 2 comprises a second cam 35.2 which is positioned opposite the first cam 35.1 as described above and shown in FIG. 2C. In use, the first and second cams 35.1, 35.2 provide an axial force to the tamper-evident ring 3 at two locations which eliminates an introduction of a moment and contributes to a proper guidance of the tamper-evident ring 3. Preferably, the cap 2 comprises two cams to prevent a tilting of the tamper-evident ring 3 when pressing the ring 3 downwards.

The closure assembly is further shown in FIG. 3A-FIG. 3E.

As shown in FIG. 3A, the closure assembly is in an initial state. In the initial state of the closure assembly, the closure assembly is ready for use. The closure assembly is delivered by the assembly line in the initial state. The closure assembly can be connected to a container, a plastic bottle, a package, a carton, a pouch etc. while maintaining the closure assembly in the initial state.

FIG. 3B shows a front view of the closure assembly as shown in FIG. 3A. The closure assembly comprises two items i.e. the spout 1 and the cap 2, which cap 2 includes the tamper-evident ring 3. The items of the closure assembly were separately manufactured by injection moulding. In the initial state, the cap 2 is snapped onto the spout 1. The cap 2 is snapped onto the spout 1 by moving the snap ridge 23 of the cap 2 across the snap ridge 19 at the neck 14 of the spout 1. The tamper-evident ring 3 is introduced in the inner space of 11 of the spout 1 until the at least one snap portion 33 engages with at least one of the windows 16. In the initial state, an axial movement of the cap 2 relative to the spout 1 is still available in a downwards direction, but the snapping of the snap portion 33 into the window 16 prevents an undesired release of the cap 2 from the article 1 in an upwards direction.

As shown in FIG. 3B, the window 16 of the article 1 has a width which corresponds with a width of a snap portion 33 to be received into the window. By receiving the snap portion 33 inside the window 16, a rotational movement about the main axis 6 of the snap portion 33 is limited. When exerting a rotational force onto the tamper-evident ring 3, a side face of the snap portion 33 will abut to a side face of the window 16 which will stop a further rotational movement of the tamper-evident ring 3. So, and engagement of the snap portion 33 in the window 16 provides a rotational constraint to a received tamper-evident ring 3.

FIG. 3C shows in a front view the closure assembly in a used-state. In the used-state, the cap 2 is removed from the spout 1. The cap 2 is removed by a rotational movement of the cap 2 with respect to the spout 1. During the rotational movement, the tamper-evident ring 3 is broken from the skirt 22 of the cap 2. The bridges 34 in between the skirt 22 and the base portion 32 of the tamper-evident ring 3 are broken. The base portion 32 is left behind in the inner space 11 of the article 1. Additionally, the base portion 32 is moved downwards over a stroke 's' during the rotational movement of the cap 2.

Figure 3D:
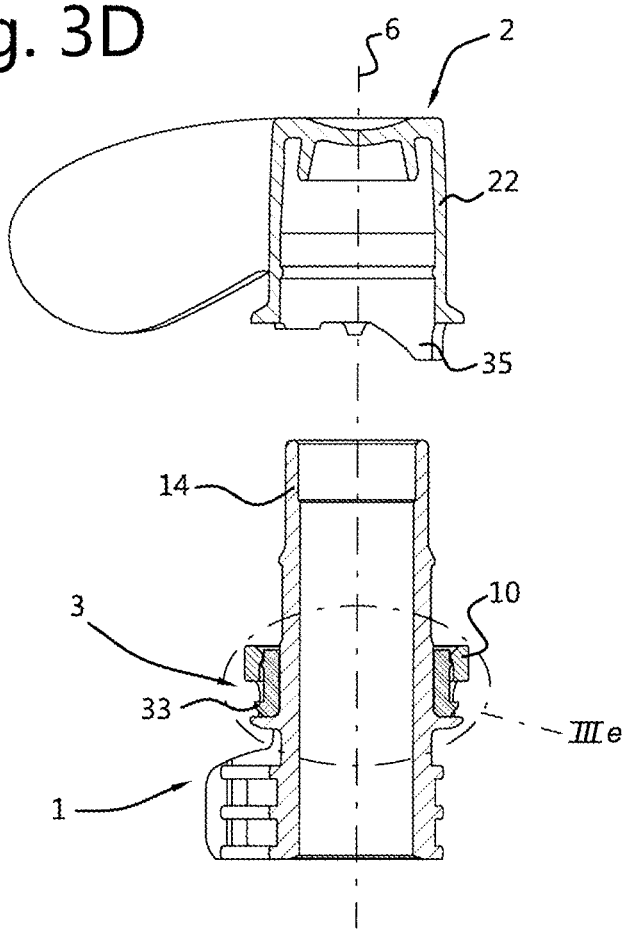
FIG. 3D shows a sectional exploded front view of the closure assembly in a used-state in which the cap is removed away from the spout and in which the tamper-evident ring is now left behind and attached to the spout.
Figure 3E:
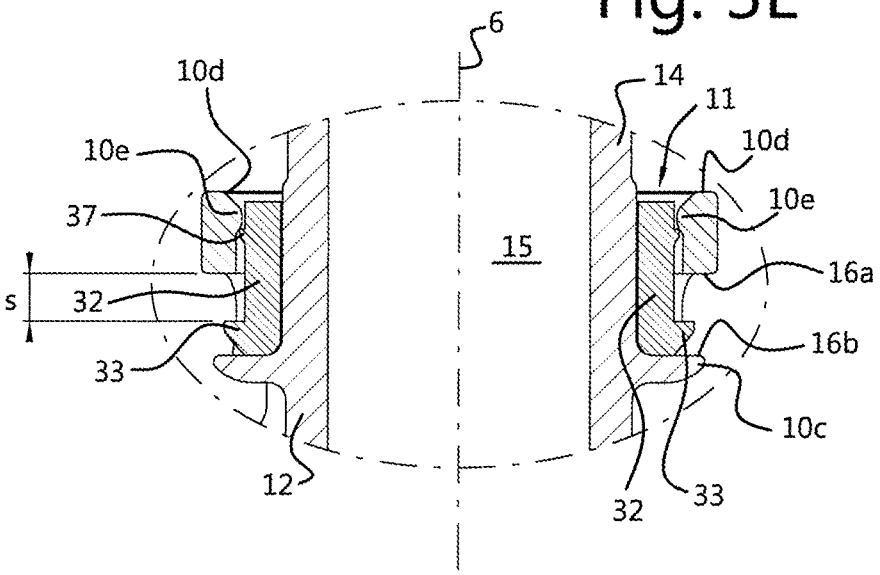
FIG. 3E shows a sectional view in a longitudinal direction about the main axis of the closure assembly of FIG. 3D.

FIG. 3D shows the closure assembly as shown in FIG. 3C in a sectional view in a longitudinal direction along the main axis 6. Subsequently, FIG. 3E shows an enlarged view of FIG. 3D to enlarge the inner space 11 of the article 1. It is shown that the base portion 32 of the tamper-evident ring 3 is situated within the inner space 11. The wall 10 shields the tamper-evident ring 3 in the inner space 11. During the rotational movement of the cap 2, the base portion 32 has moved over the stroke 's' from an upper initial position—as provided by the initial state which is provided just after an assembly of the items—to a lower position which position characterises the used-state. The lower position of the base portion 32 is a fixed position caused by an engagement of the wall ridge 10*e* and the ridge 37 at the base portion outer face 32*a*. Advantageously, the tamper-evident ring 3 is received deeply inside the inner space 11 which increases a safety of the closure assembly in the used-state.

As shown in FIG. 3E, the tamper-evident ring 3 is displaced and is arrived at its lowest position inside the inner space 11. In the lowest position, the tamper-evident ring 3 is blocked by the wall base 10*c* and cannot be displaced any further. Here, the lowest position coincidences with a lower position of a second snap connection provided by the ridge 37 and the wall ridge 10*e*. The ring 3 is displaced from the initial position to the lowest position about a stroke 's'. As is preferred, this stroke 's' is smaller than the available total stroke 'st' as indicated in FIG. 2D. Hence, a further rotation of the cap 2 will result in a lift of the cap 2 with respect to the spout 1. The cap 2 will move in upwards direction across the snap ridge 19. Advantageously, the rotational movement of the cap 2 supports a removal of a snap-on type cap from the spout.

Thus, the invention provides a closure assembly comprising a spout 1 and a cap 2 including a tamper-evident ring 3. The spout 1 has a neck 14 around a product passage 15 and a wall 10. The wall is spaced from the neck 14 to form an inner space 11 which is open from above to receive the tamper-evident ring 3. The tamper-evident ring 3 is integrally moulded via breakable bridges 34 to the cap and comprises a base portion 32 with at least one snap portion 33 at a base portion outer face 32*a*. The wall 10 of the spout 1 comprises at least one window 16, wherein the at least one snap portion 33 fits inside the window 16 to snap the tamper-evident ring 3 to the spout 1 when the tamper-evident ring 3 is inserted in the inner space 11.

With reference to the FIGS. 4A and 4B now a variant of a closure assembly according to the invention will be discussed. In this embodiment the ramp profiles on the skirt and the base portion as discussed above are absent as can be best seen in FIG. 4B when compared to FIG. 3C.

In the initial state the base portion 32 extends with a top region thereof above the circumferential wall 10 which is in particular visible if the colours are different. As can be seen snap portion 33' is snapped into window 16'.

Whilst not visible it is assumed here that the base portion 32' can be moved deeper into the inner space to a lower position thereof, as is preferred such that the base portion 32' no longer protrudes above the circumferential wall 10.

Figure 4A:
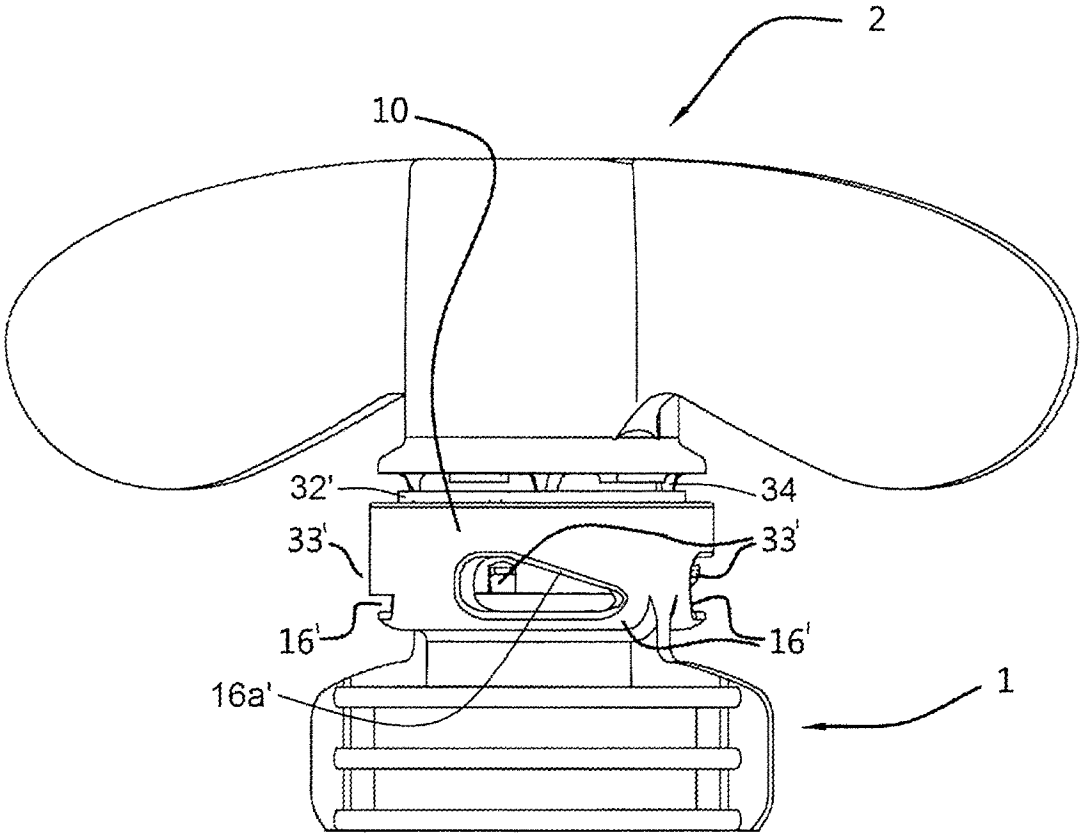
FIG. 4A shows in a view corresponding to FIG. 3C an alternative embodiment of a closure assembly according to the invention in the initial state.

In the embodiment of FIG. 4A, B it is envisaged that the base portion 32' and the circumferential wall 10 have cooperating ramp formations to cause said motion of the base portion deeper into the inner space when the user opens the closure assembly for the first time.

In more detail, in this example, the window 16' has an upper edge that forms a ramp face 16*a*', and the snap portion 33' is adapted to engage said ramp face 16*a*' and to slide along said face 16*a*' when the user rotates the cap 2'. In said opening direction of the cap 2' the ramp face 16*a*' is downwardly inclined, so that the snap portion 33' is forced downward as the user rotates the cap 2'. This causes the base portion 32' to be moved deeper into the inner space.

Figure 4B:
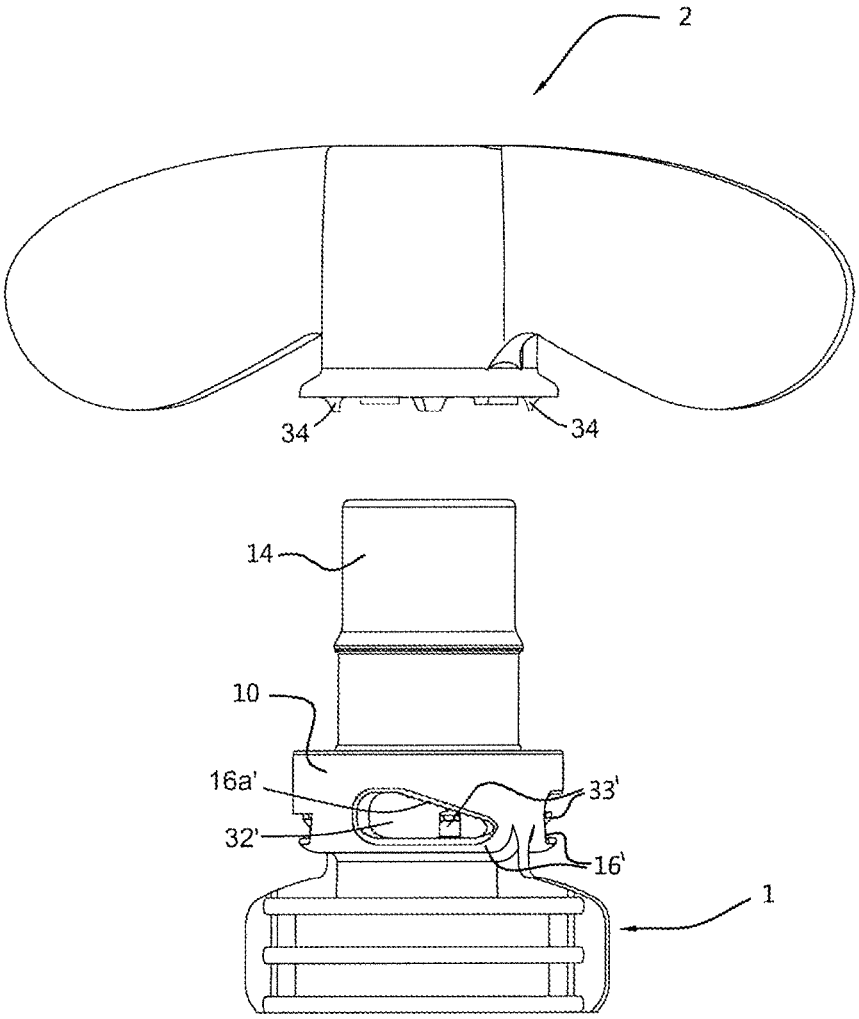
FIG. 4B shows the embodiment of FIG. 4A where the cap has been removed from the article.

Comparing the initial state of FIG. 4A to the state of FIG. 4B in view of the visual evidence of a first time removal of the cap, it is observed that in the initial position the base portion protrudes above the circumferential wall, e.g. about 1-3 millimeters, and in the lower position the base portion is hidden from lateral view by said circumferential wall. Also, one can observe that a window 16' is dimensioned such that in the initial position a lower edge of the base portion is spaced above a lower edge of the window, so that one can look underneath the base portion through the window. In the lower position the base portion is now flush with the lower edge of the window, so that the base portion effectively fills the entire window. These effects are also provided in the embodiment of FIGS. 1-3. The skilled person will appreciate that in the FIG. 4 embodiment the visual tamper-evident function is further enhanced by the fact that the snap portion 33' has clearly been moved in rotational direction within the window 16*a*' from the initial position, here from left to right.

The retention of the base member 32' in its lowered, and now also rotationally offset, position, can be effected as discussed with reference to FIGS. 1-3. In an alternative, one could embody the window and snap portion such that the snap portion becomes locked, e.g. wedged, in said position in the window and/or retained in a locking recess formed along the ramp face 16*a'*.

Upon opening the closure the downward forced motion of the base portion 32' will strain, and possibly break, the one or more bridges 34. No effective lifting of the cap 2' will now be provided as the ramp profiles of the previously discussed embodiment are absent, thereby the user will be required to then pull the cap from the neck in the case of a snap connector fit as shown.

Figure 5:
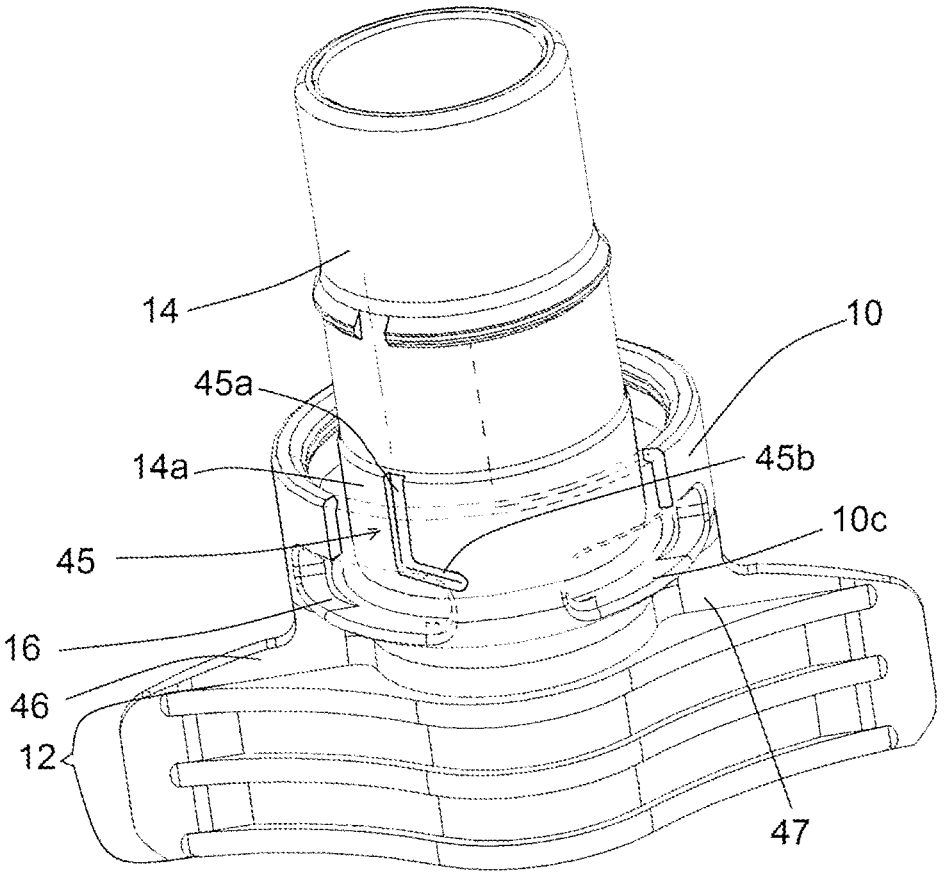
FIG. 5 shows in a perspective view, with part of the circumferential wall removed, an alternative spout according to the invention.

FIG. 5 shows in a perspective view, with part of the circumferential wall removed, an alternative spout according to the invention. This figure illustrates yet another alternative design to cause the downward motion of the tamper-evident ring from its initial position to the mentioned lowered position in the inner space between the circumferential wall 10 and the lower region 14*a* of the neck 14. This design allows to dispense with any ramp structure between the cap and the tamper-evident ring, or between the tamper-evident ring and the circumferential wall.

In more detail, the lower region 14*a* of the neck 14 is provided with a groove 45, e.g. two at diametrically opposed locations, which groove 45 is embodied in bayonet shape with a first vertical portion 45*a* and a second adjoining portion 45*b* that extends at an incline. Upon assembly of the closure assembly, with the tamper-evident ring in a higher initial position relative to the wall 10, a protrusion on the inside of the base portion of the tamper-evident ring is received in the groove portion 45*a*, preferably at the lower end thereof at the entrance of the second portion 45*b*. Upon opening of the cap, involving user induced rotation of the tamper-evident ring relative to the neck 14 and wall 10, the protrusion enters the groove portion 45*b* and is thus forced downward. This causes the tamper-evident ring to be pulled into the inner space between the neck and the circumferential wall. At some point, e.g. when the protrusion has reached the end of the portion 45*b* and/or when the ring cannot be moved further down, the ring will be blocked from any further rotation. In combination with the downward motion any breakable bridges to the cap will break and the cap will be released from the tamper-evident ring.

The bayonet cooperation between the lower region of the neck and the tamper-evident ring render it very hard to release the tamper-evident ring from the inner space.

It is shown here that the second portion 45*b* of the groove 45 is formed in the neck 14 opposite a window 16 in the circumferential wall 10. In injection molding the spout this allows to use a movable core member that forms the window 16 as well as least said second portion 45*b* of the groove 45. The first portion 45*a* can effectively be formed by another core part of the injection mold.

The same window or windows 16 are preferably also used to cooperate with a snap portion of the base portion of the tamper-evident ring as described herein, said snap portion and respective window being adapted to allow for said limited rotation of the tamper-evident ring as the protrusion travels through the second portion of the bayonet groove 45.

In the FIG. 5 it is shown that wall base 10*c*, which extends as a radial flange portion around the neck 14, is vertically spaced from the lower connector portion 12, here embodied as a well know seal boat. Here a median panel portion 46, 47 of the one piece spout is present between the lowermost region of the neck 14, the upper face of the connector portion 12, and the wall base 10*c*, each median panel portion 46, 47 lying in the vertical median plane of the connector portion. These panel portions 46, 47 provide enhanced stability of the spout, e.g. of the wall base 10*c* and the wall 10. In an alternative these panel portions are absent and, e.g. a pair of parallel flat faces are formed on opposite sides of the lowermost region of the neck allowing to guide the spout through a slot between guide rails.

The invention claimed is:

1. A closure assembly comprising an article and a cap including a tamper-evident ring, wherein:

the article is made of a plastic material and forms a tubular neck around a product passage in said article, said tubular neck having a main axis and forming a mouth at a top end of said product passage, wherein the article further comprises a circumferential wall which is positioned around a bottom region of the tubular neck and spaced from the tubular neck forming an inner space which is open from above and adapted to receive the tamper-evident ring therein, the cap is made of a plastic material and is secured on or is to be secured on said tubular neck of the article, the cap sealing the product passage in a closed position of the cap on said tubular neck, and the cap being adapted to be manually removed from the tubular neck of the article by a user to open the product passage, wherein the cap comprises a top wall and a downward depending skirt, said skirt having an interior side, an exterior side, and a lower edge remote from the top wall, wherein the tamper-evident ring is integrally formed to the lower edge of the skirt of the cap, said tamper-evident ring comprising an annular base portion which is connected via one or more breakable bridges to the skirt, a lower edge of the tamper-evident ring being a continuous ring, wherein said annular base portion is at least partially inserted or adapted to be at least partially inserted into said inner space, wherein the circumferential wall of the article comprises at least one window which extends through said circumferential wall from a wall outer face to a wall inner face, wherein said annular base portion has a base portion outer face and a base portion inner face and has at least one snap portion which is positioned at the base portion outer face, wherein the at least one snap portion is adapted to snap in the at least one window of the circumferential wall when the annular base portion of the tamper-evident ring is at least partially inserted into the inner space, wherein the at least one snap portion comprises an axial stopper face which is adapted to retain the annular base portion axially within the inner space, and wherein the closure assembly is embodied to allow that a rotation of the annular base portion received in the inner space is blocked or limited to allow that upon first time opening of the closure assembly by removal of the cap by a user the one or more bridges break and the annular base portion remains in the inner space of the article.

2. The closure assembly according to claim 1, wherein, when the cap is secured on the tubular neck, the annular base portion of the tamper-evident ring is arranged in an initial position thereof relative to said circumferential wall, and wherein the annular base portion of the tamper-evident ring is displaceable from said initial position to a lower position thereof that is deeper downward in said inner space relative to said initial position, and wherein the closure assembly is embodied to allow that a first time removal of the cap by the user, causes said annular base portion of the tamper-evident ring to be moved to said lower position.

3. The closure assembly according to claim 2, wherein, in the initial position thereof, the annular base portion of the tamper-evident ring protrudes above the circumferential wall, and wherein, in the lower position thereof, the annular base portion of the tamper-evident ring does not protrude above the circumferential wall.

4. The closure assembly according to claim 2, wherein in addition to a first or primary snap connection between the article and the tamper-evident ring provided by the at least one snap portion and a corresponding one of the at least one window in the circumferential wall, the cap further comprises at least one auxiliary or secondary snap connection structure that is activated as the annular base portion of the tamper-evident ring is moved into said lower position thereof and is adapted to retain the tamper-evident ring in said lower position.

5. The closure assembly according to claim 1, wherein the closure assembly comprises:

at least one cam including a first ramp profile in which the first ramp profile is angled with respect to the main axis, in which the at least one cam is positioned at one of the lower edge of the skirt and the annular base portion of the tamper-evident ring, and at least one cam recess in which the at least one cam recess includes a second ramp profile to interact with the first ramp profile of the at least one cam and in which the at least one cam recess is positioned opposite the at least one cam at the other one of the lower edge of the skirt and the annular base portion of the tamper-evident ring, wherein, upon first time opening of the closure assembly by rotation of the cap relative to the article about the main axis, the first and second ramp profiles interact in order to cause axial displacement of the tamper-evident ring with respect to the skirt of the cap.

6. The closure assembly according to claim 5, wherein the first and second ramp profiles define a total stroke of axial displacement of the tamper-evident ring with respect to the skirt which is larger than a stroke of axial displacement of the tamper-evident ring with respect to the article between the initial position and the lower position, thereby assisting the release of co-operating snap connector formations of the cap and the tubular neck.

7. The closure assembly according to claim 1, wherein the closure assembly comprises a snap-on type cap providing in use of the closure assembly a snap-on functionality, wherein the interior side of the skirt of the cap and an exterior side of the tubular neck of the article have co-operating snap connector formations to provide the snap-on functionality.

8. The closure assembly according to claim 1, wherein the at least one snap portion forms a protrusion which extends outward from the annular base portion outer face and which has an inclined bottom face which serves to force a portion of the circumferential wall elastically outwards when introducing the annular base portion of the tamper-evident ring into the inner space during assembly of the closure assembly.

9. The closure assembly according to claim 8, wherein at least a lower region or section of the tubular neck of the article, which delimits said inner space, has a cross-section that substantially corresponds to an inner cross-section of the annular base portion to allow that an inward motion of said at least one snap portion is substantially blocked.

10. The closure assembly according to claim 1, wherein the at least one window comprises at least one pair of windows including a first and second window which are positioned diametrically opposite each other.

11. The closure assembly according to claim 1, wherein the article is a fitment to be secured or secured to a container body.

12. The closure assembly according to claim 11, wherein the article is a spout which comprises a lower connector portion secured or to be secured between opposed film walls of a collapsible pouch container.

13. A container provided with the closure assembly according to claim 1.

14. A method for manufacturing and filling the container according to claim 13, comprising the steps of:

providing the container having the article thereon without the cap, filling the container, placing the cap onto the tubular neck of the article to allow that the cap seals the product passage and the annular base portion of the tamper-evident ring of the cap is at least partially introduced into the inner space of the article, wherein the at least one snap portion is snapped in said corresponding at least one window of the circumferential wall of the article.

15. The closure assembly according to claim 1, wherein the lower edge of the tamper-evident ring further comprises at least one snap portion at an outer lateral surface of the tamper-evident ring.

16. A closure assembly comprising an article and a cap including a tamper-evident ring, wherein:

the article is made of a plastic material and forms a tubular neck around a product passage in said article, said tubular neck having a main axis and forming a mouth at a top end of said product passage, wherein the article further comprises a circumferential wall which is positioned around a bottom region of the tubular neck and spaced from the tubular neck forming an inner space which is open from above and adapted to receive the tamper-evident ring therein, the cap is made of a plastic material and is secured on or is to be secured on said tubular neck of the article, the cap sealing the product passage in a closed position of the cap on said tubular neck, and the cap being adapted to be manually removed from the tubular neck of the article by a user to open the product passage, wherein the cap comprises a top wall and a downward depending skirt, said skirt having an interior side, an exterior side, and a lower edge remote from the top wall, wherein the tamper-evident ring is integrally formed to the lower edge of the skirt of the cap, said tamper-evident ring comprising an annular base portion which is connected via one or more breakable bridges to the skirt, wherein said annular base portion is at least partially inserted or adapted to be at least partially inserted into said inner space, wherein the circumferential wall of the article comprises at least one window which extends through said circumferential wall from a wall outer face to a wall inner face, wherein said annular base portion has a base portion outer face and a base portion inner face and has at least one snap portion which is positioned at the base portion outer face, wherein the at least one snap portion is adapted to snap in the at least one window of the circumferential wall when the annular base portion of the tamper-evident ring is at least partially inserted into the inner space, wherein the at least one snap portion comprises an axial stopper face which is adapted to retain the annular base portion axially within the inner space, and wherein the closure assembly is embodied to allow that a rotation of the annular base portion received in the inner space is blocked or limited to allow that upon first time opening of the closure assembly by removal of the cap by a user the one or more bridges break and the annular base portion remains in the inner space of the article, wherein, when the cap is secured on the tubular neck, the annular base portion of the tamper-evident ring is arranged in an initial position thereof relative to said circumferential wall, and wherein the annular base portion of the tamper-evident ring is displaceable from said initial position to a lower position thereof that is deeper downward in said inner space relative to said initial position, and wherein the closure assembly is embodied to allow that a first time removal of the cap by the user, causes said annular base portion of the tamper-evident ring to be moved to said lower position, and wherein in addition to a first or primary snap connection between the article and the tamper-evident ring provided by the at least one snap portion and a corresponding one of the at least one window in the circumferential wall, the cap further comprises at least one auxiliary or secondary snap connection structure that is activated as the annular base portion of the tamper-evident ring is moved into said lower position thereof and is adapted to retain the tamper-evident ring in said lower position.

17. The closure assembly according to claim 16, wherein, in the initial position thereof, the annular base portion of the tamper-evident ring protrudes above the circumferential wall, and wherein, in the lower position thereof, the annular base portion of the tamper-evident ring does not protrude above the circumferential wall.

18. The closure assembly according to claim 16, wherein the closure assembly comprises:

at least one cam including a first ramp profile in which the first ramp profile is angled with respect to the main axis, in which the at least one cam is positioned at one of the lower edge of the skirt and the annular base portion of the tamper-evident ring, and at least one cam recess in which the at least one cam recess includes a second ramp profile to interact with the first ramp profile of the at least one cam and in which the at least one cam recess is positioned opposite the at least one cam at the other one of the lower edge of the skirt and the annular base portion of the tamper-evident ring, wherein, upon first time opening of the closure assembly by rotation of the cap relative to the article about the main axis, the first and second ramp profiles interact in order to cause axial displacement of the tamper-evident ring with respect to the skirt of the cap.

19. The closure assembly according to claim 16, wherein the closure assembly comprises a snap-on type cap providing in use of the closure assembly a snap-on functionality, wherein the interior side of the skirt of the cap and an exterior side of the tubular neck of the article have co-operating snap connector formations to provide the snap-on functionality.

20. The closure assembly according to claim 19, wherein the first and second ramp profiles define a total stroke of axial displacement of the tamper-evident ring with respect to the skirt which is larger than a stroke of axial displacement of the tamper-evident ring with respect to the article between the initial position and the lower position, thereby assisting the release of co-operating snap connector formations of the cap and the tubular neck.

* * * * *